US006977632B2

(12) United States Patent
Mizobata

(10) Patent No.: US 6,977,632 B2
(45) Date of Patent: Dec. 20, 2005

(54) AC-TYPE PLASMA DISPLAY PANEL AND METHOD FOR DRIVING SAME

(75) Inventor: Eishi Mizobata, Tokyo (JP)

(73) Assignee: NEC Plasma Display Corporation, Tokyo (JP)

( * ) Notice: Subject to any disclaimer, the term of this patent is extended or adjusted under 35 U.S.C. 154(b) by 368 days.

(21) Appl. No.: 10/300,868

(22) Filed: Nov. 21, 2002

(65) Prior Publication Data

US 2003/0095083 A1 May 22, 2003

(30) Foreign Application Priority Data

Nov. 22, 2001 (JP) ..... 2001-356926

(51) Int. Cl.[7] ..... G09G 3/28
(52) U.S. Cl. ..... 345/60; 315/169.4
(58) Field of Search ..... 345/60–63, 66, 345/68, 74.1, 76, 208; 315/160–176; 313/450–550

(56) References Cited

U.S. PATENT DOCUMENTS 5,661,500 A 8/1997 Shinoda et al.
6,243,084 B1 * 6/2001 Nagai ..... 345/210

FOREIGN PATENT DOCUMENTS

JP 12-206933 7/2000
JP 13-282185 10/2001

OTHER PUBLICATIONS

H. Hirakawa et al., "19.2: Cell Structure and Driving Method of a 25–in. (64–cm) Diagonal High–Resolution Color ac Plasma Display", Society for Information Display '98 Digest, (May 1998), pp. 279–281 with Abstract.

* cited by examiner

*Primary Examiner*—Bipin Shalwala
*Assistant Examiner*—Mansour M. Said
(74) *Attorney, Agent, or Firm*—Sughrue Mion, PLLC

(57) ABSTRACT

By a method of the present invention, each field is made up of at least one sub-field, a sub-field of which is made up of a preliminary discharge period, a scanning period, and a sustaining period, the preliminary discharge period of which is made up of a sustaining erasing period, a priming period, and a priming erasing period, the sustaining erasing period of which is made up of a fist sustaining erasing period and a second sustaining erasing period. Negative wall charges are formed over both a scanning electrode and a common electrode in a display cell where sustaining discharge has occurred in an immediately preceding sub-field in the first sustaining erasing period and then are adjusted so that they may have almost the same amount in the second sustaining erasing period.

19 Claims, 10 Drawing Sheets

AC-TYPE PLASMA DISPLAY PANEL AND METHOD FOR DRIVING SAME

BACKGROUND OF THE INVENTION

1. Field of the Invention

The present invention relates to an AC-type plasma display panel and method for driving the same intended to reduce power dissipation and black luminance.

The present application claims priority of Japanese Patent Application No. 2001-356926 filed on Nov. 22, 2001, which is hereby incorporated by reference.

2. Description of the Related Art

Generally, a plasma display panel (hereinafter may be referred to as PDP) has many features such as thinness, comparatively ease to provide large-screen display, a large visibility angle, and a high response speed. Due to these features, a PDP has recently been utilized as a flat display in a wall-mounted TV, a public display board, or a like. The PDPs are classified by an operation type thereof into a Direct Current discharge-type (DC type) PDP in which electrodes are arranged, as exposed, in a discharge space filled with a discharge gas to generate DC discharge between the electrodes in operation and an Alternating Current discharge-type (AC type) PDP in which electrodes are coated with a dielectric layer not to be exposed to a discharge gas directly in operation of the PDP in an AC discharge condition. In a DC-type PDP, discharge is sustained for a period for which voltage is being applied, while in an AC-type PDP, discharge is sustained by alternating the polarity of voltage applied. Furthermore, the AC-type PDPs are subdivided in construction into those having two electrodes in each display cell and those having three electrodes in each display cell. Such three-electrode construction of PDPs is described, for example, in "Society for Information Display '98 Digest, pp. 279–281, May, 1998".

The following will describe a construction of a conventional three-electrode, AC-type plasma display panel and method for driving the same.

As shown in FIG. 7, this conventional three-electrode, AC-type plasma display panel is provided with a front face substrate 20 and a rear face substrate 21 arranged opposite to this front face panel 20. The front face panel 20 and the rear face panel 21 are made of glass, for example. On such a surface of the front face substrate 20 as to face the rear face substrate 21 are there arranged a plurality of scanning electrodes 22 and a plurality of common electrodes 23 alternating with each other with a predetermined spacing therebetween. The scanning electrodes 22 and the common electrodes 23 extend in a direction from a surface in FIG. 7 toward you. The scanning electrodes 22 and the common electrodes 23 are a transparent electrode made of an ITO (Indium Tin Oxide) or a like. Furthermore, on each of the scanning electrodes 22 and the common electrodes 23 is there stacked a metal electrode 32 to reduce wiring resistance. Moreover, to cover the scanning electrodes 22 and the common electrodes 23 is there provided a transparent dielectric layer 24, on which is in turn formed a MgO (Magnesium Oxide) film 25.

On such a surface of the rear face substrate 21 as to face the front face substrate 20, on the other hand, is there provided a plurality of data electrodes 29, which extends in a direction (vertical direction shown in the figure) perpendicular to the scanning electrodes 22 and the common electrodes 23. On the data electrodes 29 are there provided a white dielectric layer 28 and a phosphor layer 27.

Furthermore, between the front face substrate 20 and the rear face substrate 21 is there arranged a partition (not shown). This partition serves to preserve a space between the front face substrate 20 and rear face substrate 21 as a discharge space 26 and also divide the discharge space 26 into a plurality of display cells 31 (picture cells). The display cells each have one nearest portion between the scanning electrode 22 and the data electrode 29 and one nearest portion between the common electrode 23 and the data electrode 29. The discharge space 26 contains a mixture gas of He, Ne, Xe, or a like as a discharge gas.

Furthermore, as shown in FIG. 8, on a display screen 30 of the PDP are there arranged the display cells 31 in a matrix so that each of them may have one nearest portion between each of the scanning electrode 22 (Si (i=1–m)) and the common electrode 23 (Ci (i=1–m)) and the data electrode 29 (Dj (j=1–n)). A spacing between the scanning electrode Si and the common electrode Ci provides a surface discharge gap 33 where surface discharge occurs, while a spacing between the scanning electrode Si and the common electrode Ci–1 provides a non-discharge gap 34 where surface discharge does not occur. Note here that in this conventional PDP, the surface discharge gap 33, that is, a distance between the scanning electrode 22 and the common electrode 23 is, for example, about 70 $\mu$m, while an opposed discharge gap, that is, a distance between the scanning electrode 22 and the data electrode 29 and that between the common electrode 23 and the data electrode 29 is, for example, 120 $\mu$m. Under these conditions, surface discharge starts at a voltage of, for example, about 180V, while opposed discharge starts at a voltage of, for example, about 190V.

The following will describe a method for driving this conventional PDP. Conventionally, a method mainly used to drive a PDP has been a scanning-maintenance separated method (ADS method), whereby a scanning period and a sustaining period are separated from each other. This scanning-maintenance separated method for driving is explained below. In FIGS. 10A to 10E, a positive wall charge 35 and a negative wall charge 36 are shown in a polygon, while a height of the positive and negative wall charges 35 and 36 indicates a magnitude of a wall voltage generated by the respective wall charges on a surface of a dielectric layer. Furthermore, in FIGS. 10A to 10E, a reference symbol S indicates the scanning electrode 22 (see FIG. 7), a reference symbol C indicates the common electrode 23 (see FIG. 7), and a reference symbol D indicates the data electrode 29 (see FIG. 7). Note here that in FIGS. 10A to 10E, the MgO film 25 and the phosphor layer 27 are not shown.

In a PDP, discharge occurs in a display cell when a discharge gas is electrolytically dissociated into a positive ion and an electron and then they move in the display cell. As time passes, these positive ion and electron are recombined with each other to recover a neutral discharge gas. Therefore, the positive ion and the electron in the display cell decrease in amount as time passes. The MgO film 25 shown in FIG. 7 has a function to protect the transparent dielectric layer 24 and a function to emit a secondary electron when a positive ion in the discharge gas collies therewith. This secondary electron moves toward a positive polarity side by an electric field applied to the display cell, to collide with a molecule in the discharge gas, thus electrolytically dissociating this discharge gas molecule into a positive ion and an electron. Accordingly, more positive ions and electrons are supplied into the display cell to sustain discharge. Therefore, when starting discharge, the MgO film 25 needs to be formed on a negative polarity side beforehand always. If the MgO film 25 is not formed on the negative polarity side, no positive ion in the discharge gas collides with the MgO film and, therefore, no electron is supplied into the display cell. As a result, even if an electric field is applied to the display cell, discharge stops when positive ions and electrons present in the discharge gas before starting of discharge have all moved, so that discharge cannot be sustained.

The phosphor layer 27 shown in FIG. 7, on the other hand, emits light when irradiated with ultraviolet ray generated by discharge. An MgO film, however, does not transmit ultraviolet ray therethrough, so that the MgO film 25 cannot be formed on the phosphor layer 27. The MgO film 25, therefore, must be formed on a surface of the front face substrate 20, that is, on the scanning electrode 22 and the common electrode 23. Accordingly, to generate opposed discharge between the scanning electrode 22 or the common electrode 23 and the data electrode 29 in the display cell, the scanning electrode 22 or the common electrode 23 needs to be of a negative polarity always. Note here that to generate surface discharge between the scanning electrode 22 and the common electrode 23, either of them may be of a negative polarity.

As shown in FIG. 9, by the conventional PDP driving method, each field is made up of a plurality of sub-fields, a sub-field 8 of which is made up of three periods of a preliminary discharge period 7, a scanning period 5, and a sustaining period 6. Furthermore, the preliminary discharge period 7 is made up of a sustaining erasing period 2, a priming period 3, and a priming erasing period 4. Note here that, as shown in FIG. 9, over the entire sub-field 8, PDP driving waveforms, that is, waveforms of voltages applied to the scanning electrode 22, the common electrode 23, and the data electrode 29 are all made up of positive polarity pulses. This is because circuit costs can be reduced by thus making up the driving waveform of positive polarity pulses.

First, the preliminary discharge period 7 is explained as follows. In a previous sub-field 1 immediately preceding the sub-field 8, in each of the display cells, to the scanning electrode S is applied a positive potential Vs, while the common electrode C and the data electrode D are biased to the ground potential, The condition of a wall charge in a display cell at the beginning of the preliminary discharge period 7 depends on whether this display cell has been lit up or not in the previous sub-field 1. When discharge occurs in a display cell, an electric field in the display cell becomes uniform. Therefore, in any display cell which has been lit up in the previous sub-field 1, that is, in a display cell where sustaining discharge has been generated, an electric field in the display cell becomes uniform due to occurrence of discharge, so that as shown in FIG. 10A, the negative wall charge 36 builds up in such a region on a surface of the transparent dielectric layer 24 as to correspond to that over the scanning electrode S (hereinafter may be simply referred to as "the wall charge building up over the scanning electrode S"), the positive wall charge 35 builds up in such a region on the surface of the transparent dielectric layer 24 as to correspond to that over the common electrode C (hereinafter may be simply referred to as "the wall charge building up over the common electrode C"), and the positive wall charge 35 builds up also in such a region on the surface of the white dielectric layer 28 as to correspond to that over the data electrode D (hereinafter may be simply referred to as "the wall charge building up over the data electrode D").

In a display cell where sustaining discharge has not occurred in the previous sub-field 1, on the other hand, as shown in FIG. 10B, the negative wall charge 36 builds up over the scanning electrode S, the positive wall charge 35 builds up over the common electrode C, and the positive wall charge 35 builds up also over the data electrode D, so that an amount of the wall charges decreases continuously both in such a region over the scanning electrode S as to be near that over the common electrode C and in such a region over the common electrode C as to be near that over the scanning electrode S (hereinafter written "near surface discharge gap" also). Therefore, a total amount of the wall charges formed in the display cell is smaller than that in a display cell in which sustaining discharge has occurred in the previous sub-field 1 (see FIG. 10A).

In the sustaining erasing period 2, the potential of the scanning electrode S is continuously decreased from the positive potential Vs to the ground potential, Furthermore, the potential of the common electrode C is fixed to the positive potential Vs and that of the data electrode D is fixed to the ground potential. Accordingly, the common electrode C is of a positive polarity and the scanning electrode S, of a negative polarity. Therefore, in a display cell where sustaining discharge has occurred in the previous sub-field 1 to form a wall charge, a wall voltage is superimposed on a potential difference between the common electrode C and the scanning electrode S, so that discharge occurs at a gap (hereinafter called inter-face gap also) between the scanning electrode S and the common electrode C. However, the potential difference between the scanning electrode S and the common electrode C increases gradually, so that strong discharge does not occur abruptly but weak discharge (feeble discharge) occurs continuously. Note here that feeble discharge refers to weak discharge which is sustained while a voltage at the discharge gap is sustained at roughly a discharge starting voltage. Accordingly, as shown in FIG. 10B, it is possible to decrease an amount of a wall charge near the surface discharge gap of those wall charges formed over the scanning electrode S and the common electrode C. Note here that in the preliminary discharge period 7, the data electrode is always biased to the ground potential.

In a display cell where no sustaining discharge has occurred in the previous sub-field 1, on the other hand, a wall charge is formed only a little in the display cell, so that inter-face feeble discharge does not occur. Accordingly, the condition of the wall charge remains unchanged in a condition shown in FIG. 10B.

Thus, by generating discharge in a display cell where sustaining discharge has occurred in the previous sub-field 1, it is possible to provide, in the sustaining erasing period 2, the same wall charge arrangement as that of a display cell wherein sustaining discharge has not occurred in the previous sub-field 1. That is, at the end of the sustaining erasing period 2, there is given such a wall charge arrangement as shown in FIG. 10B independently of whether a relevant display cell has been lit up or not in the previous sub-field 1. That is, the arrangement of a display cell wall charge can be initialized.

In the priming period 3, priming discharge is generated to obtain a priming effect in order to generate write-in discharge at a low voltage in a following process. Priming discharge occurs in each sub-field independently of whether a relevant display cell has been lit up or not in the previous sub-field 1. Therefore, priming discharge needs to be feeble in order to avoid a rise in luminance in the case of black display, that is, black luminance. As shown in FIG. 9, in the priming period 3, the potential of the scanning electrode S is increased to the potential Vs and then continuously increased from the potential Vs to a potential Vp higher than the potential Vs. That is, a voltage of a positive-polarity ramp waveform is applied to the scanning electrode S. The potential of the common electrode C, on the other hand, is set to the ground. Accordingly, the scanning electrode S becomes of a positive polarity and the common electrode C becomes of a negative polarity, so that a potential difference larger than a surface-firing voltage is applied to a gap (inter-face gap) between the scanning electrode S and the common electrode C, thus generating feeble discharge at the inter-face gap. This feeble discharge is called priming discharge. Priming discharge causes a discharge gas in a display cell to be electrolytically dissociated, thus supplying a positive ion and an electron into the display cell. Accordingly, discharge is liable to occur in the later-described scanning period 5 and sustaining discharge period 6. Note here that, when priming discharge has occurred, resultantly such a wall charge arrangement is given as shown in FIG. 10C, in which a negative wall charge builds up over the scanning electrode S, a positive wall charge builds up over the common electrode C, and a positive wall charge builds up over the data electrode D, thus providing such a condition that an amount of wall charges formed in a region near the discharge gap over the scanning electrode S and the common electrode C is larger than that formed in the other regions.

In the priming erasing period 4, the potential of the scanning electrode S is non-continuously decreased to the potential Vs and then decreased from the potential Vs to the ground potential continuously. The potential of the common electrode C, on the other hand, is set to the potential Vs. Accordingly, opposite to a condition in the priming period 3 described above, the scanning electrode S becomes of a negative polarity and the common electrode C becomes of a positive polarity. Therefore, the inter-face gap encounters feeble discharge opposite to the priming discharge described above, that is, priming erasing discharge, so that a wall charge formed by priming discharge can be erased. To prevent black luminance from rising, priming erasing discharge also needs to be feeble as in the case of priming discharge. When priming erasing discharge has occurred, resultantly such a wall charge arrangement is provided in a display cell as shown in FIG. 10D, The wall charge arrangement shown in FIG. 10D is the same as that shown in FIG. 10B, that is, a wall charge arrangement before priming discharge. Then, the preliminary discharge period 7 ends.

In the scanning period 5, a positive potential Vbw is applied to the scanning electrode S and a positive potential Vsw is applied to the common electrode C. The potential Vbw is, for example, 50 to 100V approximately and the potential Vsw is, for example, 170 to 190V approximately. In such a state, a negative scanning pulse 9 is applied to the scanning electrodes Sl through Sm. In synchronization with this scanning pulse 9 in timing, a data pulse 10 is selectively applied to data electrodes D1–Dn based on display data. The voltage of the data pulse 10 is set to, for example, 60 to 70V. In a picture cell to which the data pulse 10 has been applied, a total voltage of the scanning pulse 9 and the data pulse 10 is applied to a gap (hereinafter called opposed gap) between the scanning electrode S and the data electrode D. Accordingly, a potential difference across an opposed gap exceeds an opposed-firing voltage, thus generating write-in discharge. Furthermore, since the positive potential Vsw is applied to the common electrode C, when the write-in discharge described above occurs, correspondingly a charge moves in the gap (inter-face gap) between the scanning electrode S and the common electrode C.

Note here that, as described above, to generate opposed discharge, it is necessary to set a polarity of the scanning electrode S to be negative with respect to that of the data electrode D. Furthermore, in the present PDP, waveforms all need to be of a positive polarity in order to reduce the circuit costs. Therefore, by biasing the scanning electrode S to the ground potential in a pulse shape with respect to the potential Vbw, the scanning pulse 9 of a negative polarity is realized.

Furthermore, in write-in discharge, the scanning electrode S is of a negative polarity and the data electrode D, of a positive polarity. Accordingly, to generate write-in discharge efficiently, before write-in discharge occurs, it is necessary to have a negative wall charge over the scanning electrode S and a positive wall charge over the data electrode D beforehand. When write-in discharge occurs in such a state, the wall charge over the scanning electrode S turns positive. At this moment, the wall charge over the common electrode C must be of a negative polarity already in order to generate sustaining discharge in the following sustaining period 6. As shown in FIG. 10B, however, at the end of the sustaining erasing period 2, a negative wall charge is already formed over the common electrode C to thus permit only feeble discharge to occur in the priming period 3 and the priming erasing period 4, so that even at the end of the priming erasing period 4, the polarity of the wall charge over the common electrode C is negative. As described above, when generating write-in discharge, therefore, it is necessary to apply a positive potential to the common electrode C to thereby generate surface discharge in write-in discharge, thus reversing the polarity of the wall charge over the common electrode C.

As a result, in a display cell where write-in discharge has occurred, the scanning electrode S is of a negative polarity as shown in FIG. 10E, so that a positive wall charge builds up over the scanning electrode S. Furthermore, since the common electrode C is biased to a positive polarity potential, a negative wall charge builds up over the common electrode C. Furthermore, the data electrode D is positive in polarity with respect to the scanning electrode S but negative with respect to the common electrode C, so that little wall charge builds up over the data electrode D.

In a display cell where the data pulse 10 is not applied, on the other hand, application of the scanning pulse 9 alone is not enough to permit the potential of the opposed gap to reach the opposed-firing voltage, so that write-in discharge does not occur. Accordingly, the condition of the wall charge remains unchanged. Thus, two conditions of a wall charge can be created for each display cell by applying or not allying the data pulse 10. In a hatched portion of the data pulse 10 in FIG. 9, the data pulse 10 may be applied or not applied according to display data.

When the scanning pulse 9 has been applied to all of the scanning electrodes S (Sl–Sm), the sustaining period 6 is entered. In the sustaining period 6, a sustaining pulse is applied to all of the scanning electrodes S and all of the common electrodes C alternately. The voltage Vs of the sustaining pulse is supposed to be of such a value that surface discharge may occur in a display cell where write-in discharge has occurred in the above-mentioned scanning period 5 to form a wall charge as shown in FIG. 10E but may not occur in a display cell where write-in discharge has not occurred and so a wall charge arrangement may remain unchanged as shown in FIG. 10D. The voltage Vs of the sustaining pulse is set to, for example, 170V.

The following will describe the sustaining period 6 specifically. In the sustaining period 6, first, a positive sustaining pulse (hereinafter called first sustaining pulse) is applied to the scanning electrode S and the ground potential is applied to the common electrode C. Note here that in the sustaining period 6, the potential of the data electrode D is always at the ground potential. Then, in a display cell where write-in discharge has occurred in the scanning period 5, a large positive charge is formed over the scanning electrode S and a large negative wall charge is formed over the common electrode C, so that a wall voltage due to this positive wall charge is superimposed on the first sustaining pulse applied to the scanning electrode S to thereby apply a voltage higher than a surface-firing voltage to the inter-face gap, thus generating sustaining discharge. The sustaining discharge thus generated causes a negative wall charge to build up over the scanning electrode S and a positive wall charge to build up over the common electrode C. In a display cell where write-in discharge has not occurred in the scanning period 5, no wall voltage is superimposed on the first sustaining pulse and so a voltage of the inter-face gap does not reach the surface-firing voltage, so that sustaining discharge does not occur.

A next sustaining pulse (hereinafter called second sustaining pulse) is applied to the common electrode C. At the same time, the ground potential is applied to the scanning electrode S. In this case, in a display cell where sustaining discharge has occurred owing to the above-mentioned first sustaining pulse, the second sustaining pulse is superimposed on a wall charge formed through sustaining discharge due to this first sustaining pulse, thus generating sustaining discharge. Accordingly, a wall charge having a polarity opposite to that when sustaining discharge has occurred owing to the first sustaining pulse builds up over the scanning electrode S and the common electrode C. That is, a wall charge arrangement returns to that shown in FIG. 10E. From this moment on, discharge occurs sustainedly based on almost the same principle. That is, a potential difference due to a wall charge generated by the x'th sustaining discharge is superimposed on the (x+1)'th sustaining pulse to thereby sustain sustaining discharge. The number of times this sustaining discharge is sustained determines an amount of light emitted.

At a picture cell where no write-in discharge has occurred, on the other hand, no wall charge is superimposed on a sustaining pulse. Application of the sustaining pulse alone is not enough to attain a discharge starting voltage, so that surface discharge does not occur.

The above-mentioned preliminary period 7, scanning period 5, and sustaining period 6 are combined to make up the sub-field 8. To display an image on a PDP, gradation of the image can be displayed by providing mutually different numbers of sustaining pulses in different sub-fields in one field which is a period for displaying image information of one screen and selecting whether each of these sub-fields is to be lit up or not in order to control the number of times of generating sustaining discharge.

This conventional technology, however, has the following problems. First, in a conventional PDP, as shown in FIG. 10D, immediately preceding the scanning period 5, such a wall charge arrangement is present that a negative wall charge is formed over the scanning electrode S and a positive wall charge is formed over the common electrode C. Therefore, if write-in discharge occurs in the scanning period 5, as described above, charged particles generated by discharge at the opposed gap spread in a display cell and so move also between respective surface electrodes of the scanning electrode and the common electrode. Accordingly, a larger write-in discharge current occurs to increase power dissipation of a scanning driver and costs thereof as well.

Second, as shown in FIGS. 10B–10D, surface discharge occurs in the priming period 3 and the priming erasing period 4, so that black luminance of the PDP becomes large to decrease contrast of image display.

SUMMARY OF THE INVENTION

In view of the above, the present invention has been developed and it is an object of the present invention to provide a plasma display panel and method for driving the same which suppresses a write-in discharge current in write-in operation to reduce power dissipation of a scanning driver. It is another object of the present invention to provide a plasma display panel and method for driving the same which reduces black luminance.

According to a first aspect of the present invention, there is provide an AC-type plasma display panel including: a first insulation substrate and a second insulation substrate arranged opposite each other, a plurality of scanning electrodes and a plurality of common electrodes alternatively arranged on an opposition surface of said first insulation substrate to said second insulation substrate in a first direction, a plurality of data electrodes arranged on an opposition side of said second insulation substrate to said first insulation substrate in a second direction perpendicular to said first direction, a first dielectric layer formed to cover said plurality of scanning electrodes and said plurality of common electrodes, a second dielectric layer formed to cover said plurality of data electrodes, a plurality of discharge gaps arranged between said scanning electrodes and said common electrodes, and a plurality of picture cells each of which includes one of cross points of said discharge gaps and data electrodes;

wherein a surface-firing voltage between such a scanning electrode region as to correspond to a region over said scanning electrode and such a common electrode region as to correspond to a region over said common electrode on a surface of said first dielectric layer in said picture cell is higher than an opposed-firing voltage between each of said scanning electrode region and said common electrode region and such a region on a surface of said second dielectric layer as to correspond to a region over said data electrode.

With configuration of the above first aspect, by setting the surface-firing voltage higher than the opposed-firing voltage, it is possible to make it difficult for surface discharge to occur than opposed discharge to thereby reduce a proportion of surface discharge in priming discharge and priming erasing discharge. This makes it possible to suppress an increase in black luminance accompanying priming discharge and priming erasing discharge. Note here that black luminance refers to luminance in the case of black display in a condition where there is no surrounding light, that is, display given by the lowest luminance. That is, the black luminance is exactly the lowest luminance of light emitted from the PDP and so does not contain luminance given by reflection of external light.

In the foregoing first aspect, a preferable mode is one wherein a difference between the surface-firing voltage and the opposed-firing voltage is 50 to 120V.

With this mode, it is possible to generate opposed discharge stably and also prevent the surface-firing voltage from becoming excessive, thus suppressing a voltage of the sustaining pulse to a low level. As a result, costs for driving the PDP can be suppressed.

According to a second aspect of the present invention, there is provide an AC-type plasma display panel driving method for driving, based on display data, an AC-type plasma display panel comprising: a first insulation substrate and a second insulation substrate arranged opposite each other, a plurality of scanning electrodes and a plurality of common electrodes alternatively arranged on an opposition surface of said first insulation substrate to said second insulation substrate in a first direction, a plurality of data electrodes arranged on an opposition side of said second insulation substrate to said first insulation substrate in a second direction perpendicular to said first direction, a first dielectric layer formed to cover said plurality of scanning electrodes and said plurality of common electrodes, a second dielectric layer formed to cover said plurality of data electrodes, a plurality of discharge gaps arranged between said scanning electrodes and said common electrodes, and a plurality of picture cells each of which includes one of cross points of said discharge gaps and data electrodes;

said method comprising the steps of:

sub-dividing each of fields which displays one image into one or a plurality of sub-fields, said one or plurality of sub-fields having a preliminary discharge period for initializing a charge condition in each of said picture cells, a scanning period for forming a wall charge selectively in said picture cells based on said display data, and a sustaining period for applying a voltage to said scanning electrode and said common electrode alternately to thereby generate sustaining discharge, in the picture cell where said wall charge is formed, between a scanning electrode region which corresponds to a region over said scanning electrode and a common electrode region which corresponds to a region over said common electrode on said surface of said first dielectric layer; and forming a negative wall charge in both said scanning electrode region and said common electrode region in said preliminary discharge period.

With configuration of the second aspect, by forming a negative wall charge over the scanning electrode and the common electrode at a picture cell in the preliminary discharge period, it is possible to prevent a charge from moving between the scanning electrode and the common electrode in a scanning period, thus reducing power dissipation.

In the foregoing second aspect, a first preferable mode is one wherein the preliminary discharge period has a sustaining erasing period for initializing a charge condition in each of the picture cells, in which sustaining erasing period a negative wall charge is formed in both the scanning electrode region and the common electrode region.

A second preferable mode is one wherein, in at least one sub-field of the sub-fields, the preliminary discharge period has a priming period for generating priming discharge in the picture cells to thereby make it easy to generate discharge in the picture cells and a priming erasing period for erasing a wall charge generated by the priming discharge.

A third preferable mode is one wherein, in the preliminary discharge period, the sustaining erasing period precedes in timing the priming period and the priming erasing period.

A fourth preferable mode is one wherein the sustaining erasing period is made up of a first sustaining erasing period and a second sustaining erasing period, the method further including the steps of;

in the first sustaining erasing period, applying different potentials higher than a potential of the data electrode to the scanning electrode and the common electrode to thereby generate surface discharge between the scanning electrode region and the common electrode region in order to form a negative wall charge in the scanning electrode region and the common electrode region; and in the second sustaining erasing period, generating opposed discharge between the scanning electrode region or the common electrode region and such a data electrode region on the surface of the second dielectric layer as to correspond to a region over the data electrode to thereby adjust an amount of a wall charge in the scanning electrode region, the common electrode region, and the data electrode region in such a manner that a magnitude of a wall voltage generated by the wall charge between the scanning electrode region and the data electrode region and a magnitude of a wall voltage generated between the common electrode region and the data electrode region may be less than an opposed-firing voltage between each of the scanning electrode region and the common electrode region and the data electrode region.

With the fourth preferable mode, a negative wall charge can be formed in both the scanning electrode region and the common electrode region each time discharge occurs in the first sustaining erasing period. Furthermore, by adjusting an amount of a wall charge in the scanning electrode region and the common electrode region in the second sustaining erasing period so that a magnitude of a wall voltage thereof with respect to the data electrode may be less than the opposed-firing voltage, it is possible to prevent error discharge from occurring at the opposed gap in the scanning period and the sustaining period by biasing the potential of the scanning electrode or the common electrode to the ground potential.

Also, a fifth preferable mode is one wherein by the step of forming a negative wall charge in the scanning electrode region and the common electrode region in the first sustaining erasing period, a potential difference between a potential applied to the scanning electrode and a potential applied to the common electrode is set not less than a voltage obtained by subtracting from a surface-firing voltage between the scanning electrode region and the common electrode region a wall voltage generated between the scanning electrode region and the common electrode region owing to a wall charge formed by sustaining discharge in a sub-field immediately preceding a sub-field to which the first sustaining erasing period belongs and less than the surface-firing voltage.

With the fifth preferable mode, it is possible to generate surface discharge in the first sustaining erasing period only at a picture cell where sustaining discharge has occurred in the previous sub-field. As a result, it is possible to provide a picture cell where the sustaining discharge ha occurred with the same wall charge arrangement as that of a picture cell where sustaining discharge ha not occurred.

A sixth preferable mode is one wherein by the step of adjusting an amount of a wall charge in the scanning electrode region, the common electrode region, and the data electrode region in the second sustaining erasing period, a potential of the scanning electrode or the common electrode whichever is higher in potential is decreased by a potential not less than the opposed-firing voltage in the first sustaining erasing period while sustaining a potential of the scanning electrode and a potential of the common electrode higher than a potential of the data electrode.

With the sixth preferable mode, it is possible to generate opposed discharge between a scanning electrode or a common electrode whichever has a higher potential and a data electrode. As a result, it is possible to adjust an amount of a charge over the scanning electrode and the common electrode.

An eighth preferable mode is wherein by the step of adjusting an amount of a wall charge in the scanning electrode region, the common electrode region, and the data electrode region in the second sustaining erasing period, a potential difference between the scanning electrode and the data electrode is set to a value less than the opposed-firing voltage and a potential difference between the common electrode and the data electrode is set to a value less than the opposed-firing voltage.

With the eighth preferable mode, it is possible to adjust an amount of a wall charge in a scanning electrode region and a common electrode region so that wall voltages thereof with respect to a data electrode may be less than the opposed-firing voltage. As a result, it is possible to prevent error discharge from occurring at the opposed gap of a picture cell where no wall charge has been formed in a scanning period when a scanning electrode or a common electrode is biased to the ground potential in a scanning period and a sustaining period.

A ninth preferable mode is one that wherein further includes the steps of:

in the priming period, continuously increasing a potential of either one of the scanning electrode and the common electrode from a first potential to a second potential which is higher than the first potential and whose potential difference from a potential of the data electrode is not less than the opposed-firing voltage and, at the same time, setting a potential of the other electrode to a third potential which is lower than the second potential and whose potential difference from the second potential is less than the opposed-firing voltage; and in the priming erasing period, decreasing a potential of the either one electrode from the second potential to a fourth potential which is lower than the second potential and whose potential difference from a potential of the second potential is less than the opposed-firing, voltage and then continuously decreasing the potential of the either one electrode from the fourth potential to the potential applied to the data electrode.

With the ninth preferable mode, it is possible to generate priming discharge at the opposed gap in a priming period and also priming erasing discharge at the opposed gap in a priming erasing period. In this case, in both the priming discharge and the priming erasing discharge, an occurrence of surface discharge can be suppressed, to reduce black luminance.

Also, a tenth preferable mode is one wherein the potential applied to the data electrode is biased to a ground potential.

A eleventh preferable mode is one wherein in the AC-type plasma display panel, a surface-firing voltage between the scanning electrode region and the common electrode region is higher than an opposed-firing voltage between each of the scanning electrode region and the common electrode region and such a data electrode region on the second dielectric layer surface as to correspond to a region over the data electrode.

A twelfth preferable mode is one wherein a difference between the surface-firing voltage and the opposed-firing voltage is 50 to 120V.

According to a third aspect of the present invention, there is provided an AC-type plasma display panel driving method for causing display to be provided based on display data on an AC-type plasma display panel including first and second insulation substrates which are arranged as opposed to each other, a plurality of scanning electrodes and a plurality of common electrodes which are alternately arranged on such a surface of the first insulation substrate as to face the second insulation substrate and which extend in a first direction, a first dielectric layer which covers the scanning electrodes and the common electrodes, a plurality of data electrodes which is provided on such a surface of the second insulation substrate as to face the first insulation substrate and which extends in a second direction perpendicular to the first direction, and a second dielectric layer which covers the data electrodes in such a configuration that picture cells are formed in a matrix in such a manner as to each have one nearest point between the data electrode and each of the scanning electrode and the common electrode and a surface-firing voltage between the scanning electrode region and the common electrode region is higher than an opposed-firing voltage between each of the scanning electrode region and the common electrode region and such a data electrode region on the surface of the second dielectric layer as to correspond to a region over the data electrode, each of fields which displays one image is sub-divided into one or a plurality of sub-fields, the plurality of sub-fields having a preliminary discharge period for initializing a charge condition in each of the picture cells and also making occurrence of discharge easy, a scanning period for forming a wall charge selectively in the picture cells based on the display data, and a sustaining period for applying a voltage to the scanning electrode and the common electrode alternately to thereby generate sustaining discharge, in the picture cell where the wall charge is formed, between the scanning electrode region and the common electrode region, the preliminary discharge period having a sustaining erasing period for initializing a charge condition in each of the picture cells, a priming period for generating priming discharge in the picture cells to thereby make occurrence of discharge easy in the picture cells, and a priming erasing period for erasing the wall charge generated by the priming discharge, and the sustaining erasing period being made up of a first sustaining erasing period and a second sustaining erasing period, including the steps of:

in the first sustaining erasing period, applying the ground potential to the data electrode, a first positive potential to a first surface electrode which is the scanning electrode or the common electrode whichever has lower potential applied thereto at the end of a sub-field immediately preceding a sub-field to which the first sustaining erasing period belongs, and a second positive potential which is less than the first positive potential, whose potential difference from the first positive potential is not less than a voltage obtained by subtracting from the surface-firing voltage a wall voltage generated between the scanning electrode region and the common electrode region owing to the wall charge formed by sustaining discharge in the immediately preceding sub-field, and which is less than the surface-firing voltage to a second surface electrode which is the scanning electrode or the common electrode whichever is not the first surface electrode, to generate surface discharge only in the picture cell where sustaining discharge has occurred in the immediately preceding sub-field in order to form a negative wall charge in both the scanning electrode region and the common electrode region; and in the second sustaining erasing period, decreasing the potential of the first surface electrode to a third positive potential which is less than the first positive potential, whose potential difference from the first positive potential is not less than the opposed-firing voltage, and whose potential difference from the ground potential is less than the opposed-firing voltage and, at the same time, setting the potential of the second surface electrode to a fourth positive potential whose potential difference from the ground potential is less than the opposed-firing voltage to generate opposed discharge between the scanning electrode region or the common electrode region and the data electrode region to thereby adjust an amount of a wall charge in the scanning electrode region, the common electrode region, and the data electrode region in such a manner that both a magnitude of a wall voltage generated by the wall charge between the scanning electrode region and the data electrode region and a magnitude of a wall voltage generated between the common electrode region and the data electrode region may become less than the opposed-firing voltage.

In the foregoing third aspect, a preferable mode is one wherein the first surface electrode is the scanning electrode and the second surface electrode is the common electrode.

Another preferable mode is one wherein the first surface electrode is the common electrode and the second surface electrode is the scanning electrode.

Still another preferable mode is one that wherein further includes the steps of:

in the priming period, applying the ground potential to the data electrode and continuously increasing a potential of the scanning electrode from the fourth positive potential to a fifth positive potential which is higher than the fourth potential and whose potential difference from the ground potential is not less than the opposed-firing voltage and, at the same time, continuously changing a potential of the common electrode from the third positive potential to a sixth positive potential whose potential difference from the fifth positive potential is less than the opposed-firing voltage; and in the priming erasing period, while applying the ground potential to the data electrode, decreasing the potential of the scanning electrode from the fifth positive potential to a seventh positive potential which is less than the fifth positive potential and whose potential difference from the fifth positive potential is less than the opposed-firing voltage and then continuously decreasing from the seventh positive potential to the ground potential and, at the same time, applying the seventh positive potential to the common electrode.

A furthermore preferable mode is one that wherein further includes the steps of:

in the scanning period, applying an eighth positive potential whose potential difference from the ground potential is less than the opposed-firing voltage to the scanning electrode and sequentially applying to the scanning electrodes a negative scanning pulse decreasing in potential to the ground potential and, at the same time, applying a data pulse selectively to the data electrodes at the same timing as that of the scanning pulse based on the display data to thereby form a wall charge selectively in the picture cells; and in the sustaining period, applying a voltage to the scanning electrode and the common electrode alternately to generate sustaining discharge between the scanning electrode region and the common electrode region only in the picture cell where the wall charge has been formed so that the picture cell may emit light.

BRIEF DESCRIPTION OF THE DRAWINGS

The above and other objects, advantages, and features of the present invention will be more apparent from the following description taken in conjunction with the accompanying drawings, in which.

DESCRIPTION OF THE PREFERRED EMBODIMENTS

Best mode of carrying out the present invention will be described in further detail using various embodiments with reference to the accompanying drawings.

First Embodiment

Figure 7:
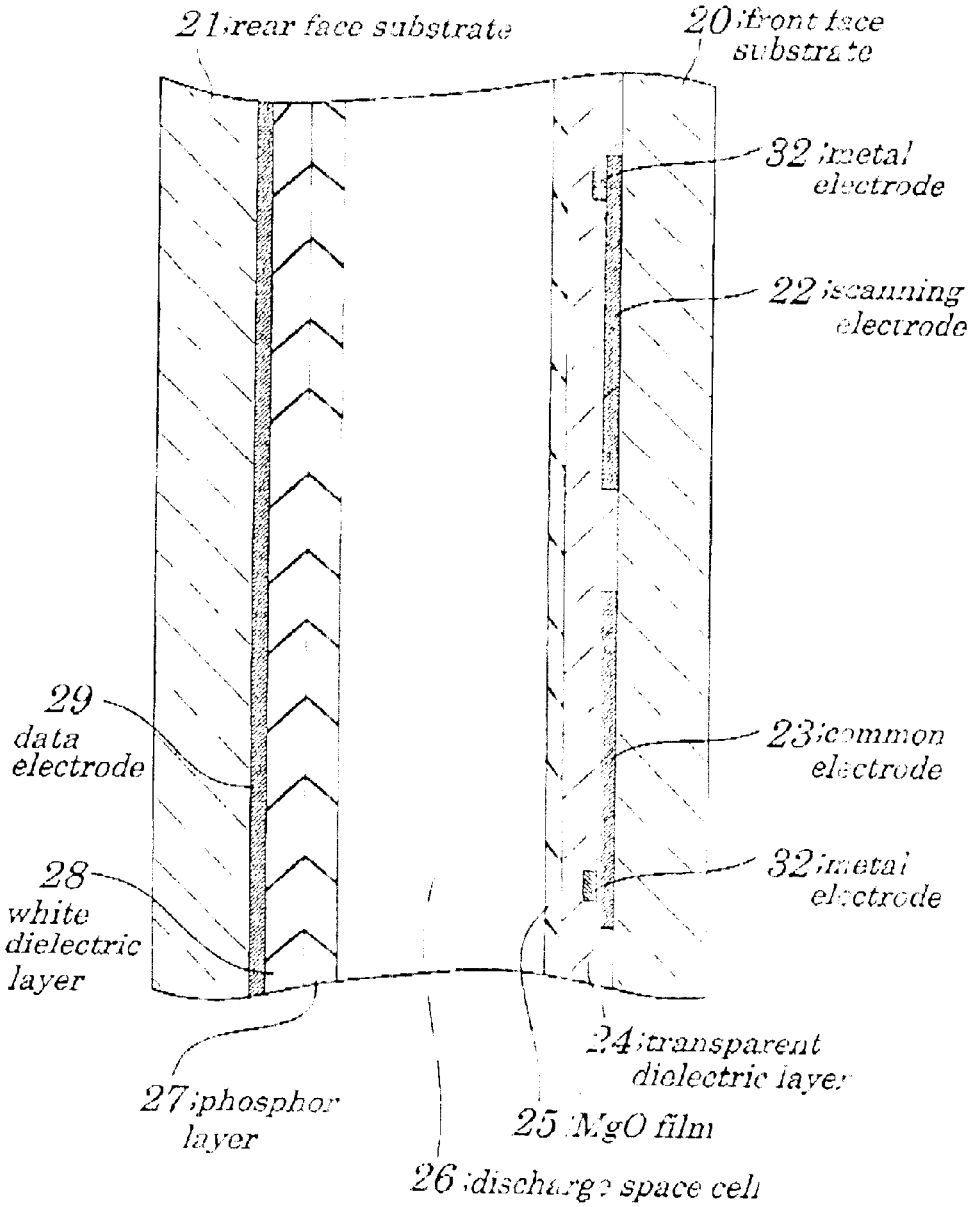
FIG. 7 (PRIOR ART)
FIG. 7 is a cross-sectional view for showing a configuration of a display cell on a plasma display panel.

The following will describe a first embodiment of the present invention. A configuration of a plasma display panel (PDP) related to the present invention is described with reference to FIGS. 7 and 8. In the PDP related to the present embodiment, as shown in FIG. 7, a front face substrate 20 and a rear face substrate 21 which are made of, for example, glass are arranged as opposite to each other. On such a surface of the front face substrate 20 as to face the rear face substrate 21 are there arranged a plurality of scanning electrodes 22 and a plurality of common electrodes 23 alternating with each other with a predetermined spacing therebetween. The scanning electrodes 22 and the common electrodes 23 extend in a direction from a surface in FIG. 7 toward you. The scanning electrodes 22 and the common electrodes 23 are a transparent electrode made of ITO or a like. Furthermore, on the scanning electrodes 22 and the common electrodes 23 is there stacked a metal electrode 32. The metal electrode 32 is provided to reduce wiring resistance, a width of which is smaller than that of the scanning electrode 22 and the common electrode 23. Moreover, to cover the scanning electrodes 22 and the common electrodes 23 is there provided a transparent dielectric layer 24, on which is in turn formed a MgO film 25. As in the case of the above-mentioned conventional PDP, in the PDP of the present embodiment also, the MgO film 25 needs to be provided on a side of the front face substrate 20.

On such a surface of the rear face substrate 21 as to face the front face substrate 20, on the other hand, is there provided a plurality of data electrodes 29, which extends in a direction perpendicular to the scanning electrodes 22 and the common electrodes 23. On the data electrodes 29 is there provided a white dielectric layer 28, on which is in turn provided a phosphor layer 27.

Furthermore, between the front face substrate 20 and the rear face substrate 21 is there arranged a partition (not shown). This partition serves to preserve a space between the front face substrate 20 and rear face substrate 21 as a discharge space 26 and also divide the discharge space 26 into a plurality of display cells 31 (picture cells). The display cells each have one nearest portion between the scanning electrode 22 and the data electrode 29 and one nearest portion between the common electrode 23 and the data electrode 29. The discharge space 26 contains a mixture gas of at least two selected from the group consisting of He, Ne, Xe, and Ar, as a discharge gas.

Figure 8:
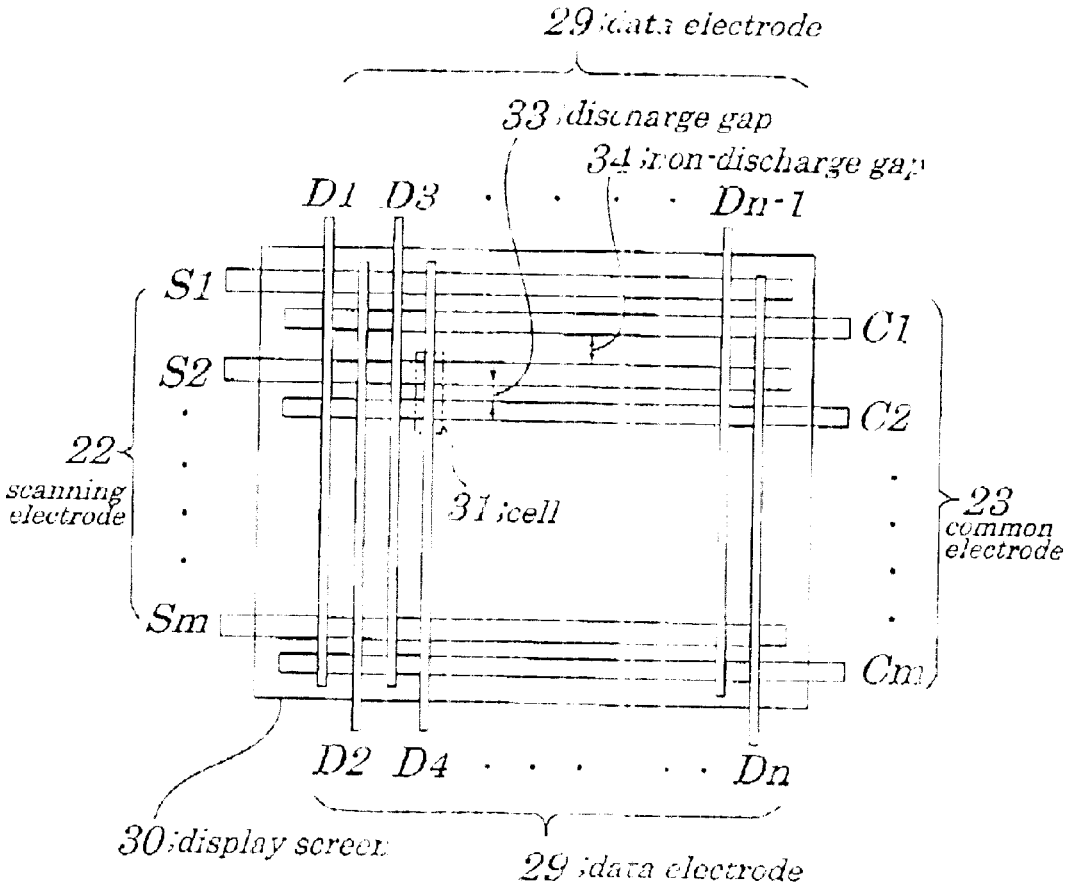
FIG.8 (PRIOR ART)
FIG. 8 is a plan view for showing an electrode arrangement on the plasma display panel of FIG. 7.

Furthermore, as shown in FIG. 8, on a display screen 30 of the PDP are there arranged the display cells 31 in a matrix so that each of them may have one nearest portion between each of the scanning electrode 22 (Si (i=1–m))) and the common electrode (Ci (i=1–m)) and the data electrode 29 (Dj (j=1–n)). A spacing between the scanning electrode Si and the common electrode Ci provides a surface discharge gap 33 where surface discharge occurs, while a spacing between the scanning electrode Si and the common electrode Ci–1 provides a non-discharge gap 34 where surface discharge does not occur. Note here that the display screen 30 measures 50 inches×40 inches and has 768×1028 picture cells each of which is made up of three display cells. The three display cells making up each picture cell are arrayed in a horizontal direction of the display screen 30, in each of which display cells the phosphor layer 27 (see FIG. 7) is painted in three painted colors of RGB (read, green, and blue). Furthermore, on a front face side of the PDP, that is, on such a side of the front face substrate 20 as not to face the rear face substrate 21 is there provided a front face filter (not shown).

The display cell of the PDP of the present embodiment has a lower opposed-firing voltage than a surface-firing voltage and so is liable to encounter opposed discharge. For example, it is adjusted that the surface-firing voltage between the scanning electrode and the common electrode may be about 240V and a opposed-firing voltage between the scanning electrode and the common electrode may be about 160V. Accordingly, the surface discharge gap is, for example, about 70 μm, the opposed-discharge gap is, for example, 90 μm, and a size of each display cell is, for example, 0.81 mm vertically and 0.27 mm horizontally.

As described above, in the present embodiment, the surface-firing voltage is higher than the opposed-firing voltage with a difference therebetween being 80V. In the present invention, preferably the difference between the surface-firing voltage and the opposed-firing voltage is 50 to 120V. The reason is as follows. Although discharge generally occurs in a display cell when a voltage not lower than a discharge starting voltage is applied between the electrodes, feeble discharge may occur when a voltage, even if less than the discharge starting voltage but if nearly equal thereto, is applied between the electrodes. This weak discharge has a margin of about 20 to 30V. Furthermore, if the display cells have fluctuations in size among themselves, their discharge starting voltages also fluctuate. If a difference between the surface-firing voltage and the opposed-firing voltage is 50V or more, the margin and the fluctuations of the discharge starting voltage can be absorbed, to stably generate opposed discharge in the priming discharge and the priming erasing discharge as well as opposed discharge in the second sustaining erasing period. Furthermore, if a difference between the surface-firing voltage and the opposed-firing voltage is 120V or less, the surface-firing voltage will not become excessive. This eliminates a necessity of excessively increasing a voltage of a sustaining pulse which serves to generate sustaining discharge which is surface discharge, thus enabling suppressing driving costs.

The following will describe a method for driving a PDP related to the present embodiment.

Figure 1:
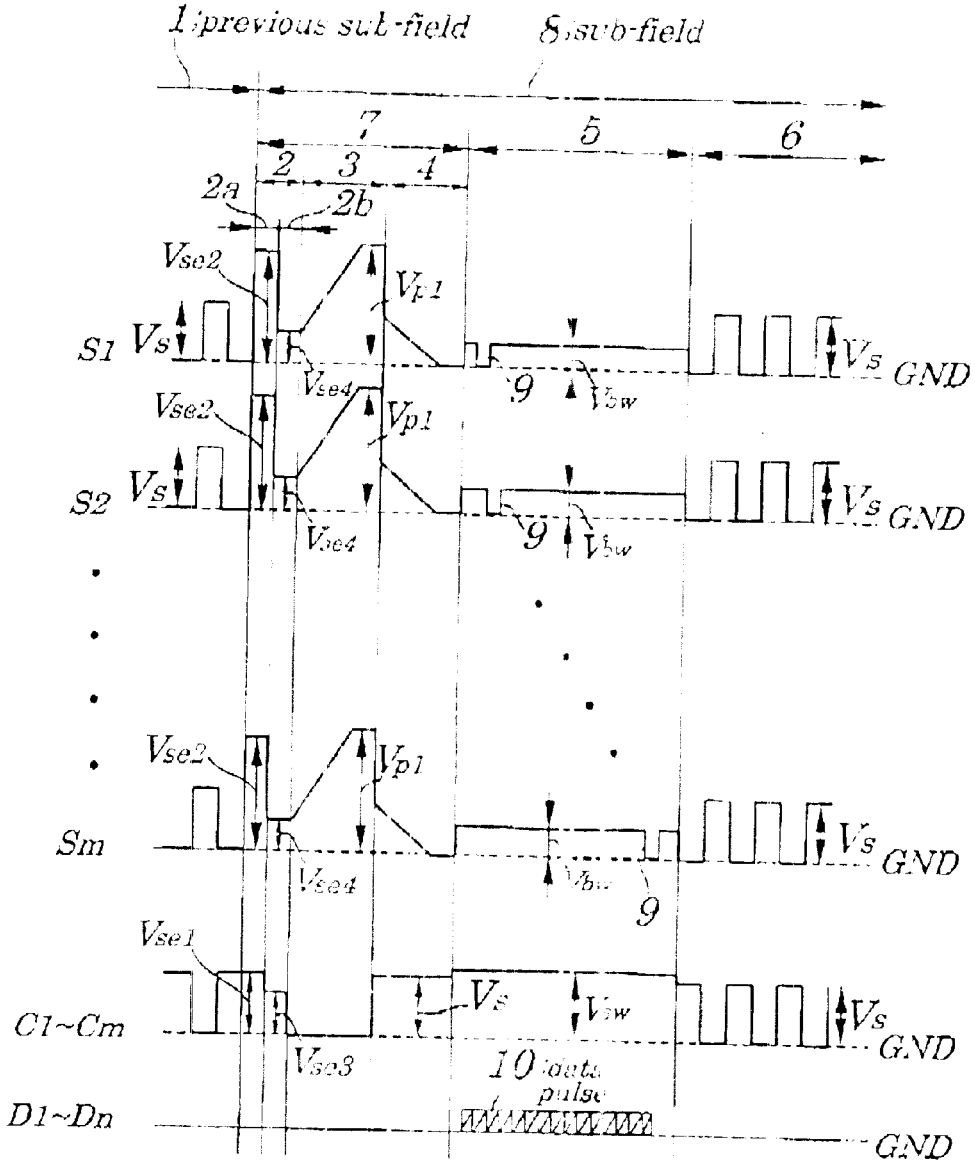
FIG. 1 is a waveform diagram for showing a method for driving a PDP related to a first embodiment of the present invention.

FIG. 1 is a waveform diagram for showing a method for driving a PDP related to the first embodiment, and FIGS. 2A to 2E are schematic cross-sectional views for showing a method for driving the PDP of FIG. 1.

As shown in FIGS. 10A to 10E and in FIGS. 2A to 2E as well, a positive wall charge 35 and a negative wall charge 36 are shown in a polygon, while a height of the positive and negative wall charges 35 and 36 indicates a value of a wall voltage that is generated by the respective wall charges on a surface of a dielectric layer. Furthermore, a reference symbol S indicates the scanning electrode 22 (see FIG. 7), a reference symbol C indicates the common electrode 23 (see FIG. 7), and a reference symbol D indicates the data electrode 29 (see FIG. 7).

As shown in FIG. 1, by the PDP driving method related to the first embodiment, each field is made up of one or a plurality of sub-fields, a sub-field 8 of which is made up of three periods of a preliminary discharge period 7, a scanning period 5, and a sustaining period 6. Furthermore, the preliminary discharge period 7 is made up of a sustaining erasing period 2, a priming period 3, and a priming erasing period 4. Note here that, as shown in FIG. 1, PDP driving waveforms are all made up of positive polarity pulses. Accordingly, circuit costs can be reduced.

Figure 2A:
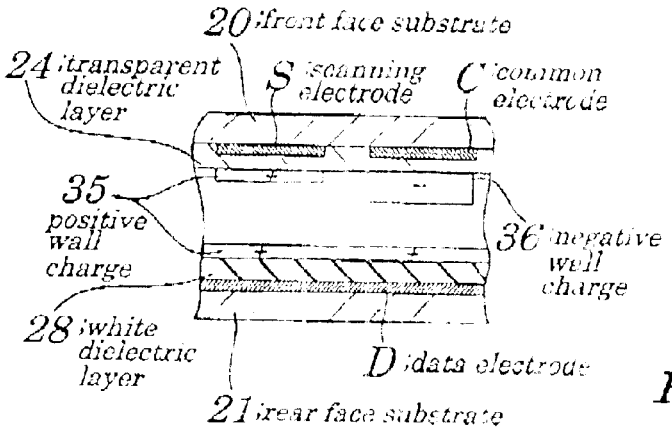
FIGS. 2A to 2E are schematic cross-sectional views for showing a method for driving the PDP of FIG. 1.

First, the preliminary discharge period 7 is explained. The condition of a wall charge in a display cell at the beginning of the preliminary discharge period 7 depends on whether this display cell has been lit up or not in a sub-field 1 (previous sub-field 1) immediately preceding the sub-field 8. In a display cell which has been lit up in the previous sub-field 1, at a moment when the last sustaining pulse of the previous sub-field 1 is applied, the ground potential is applied to the scanning electrode S and the data electrode D, while the positive potential Vs is applied to the common electrode C. In this voltage application condition, sustaining discharge has been generated already, so that an electric field in the display cell is uniform. Accordingly, as shown in FIG. 2A, in the display cell, the positive wall charge 35 builds up in such a region (over the scanning electrode S) on such a surface of the transparent dielectric layer 24 as to correspond to that over the scanning electrode S, the negative wall charge 36 builds up in such a region (over the common electrode C) on the surface of the transparent dielectric layer 24 as to correspond to that over the common electrode C, and the positive wall charge 35 builds up in such a region (over the data electrode D) on the surface of the white dielectric layer 28 as to correspond to that over the data electrode D. The potential Vs is, for example, 170V. Therefore, a voltage (wall voltage) due to a wall charge over the scanning electrode S and the common electrode C is also 170V.

Figure 2B:
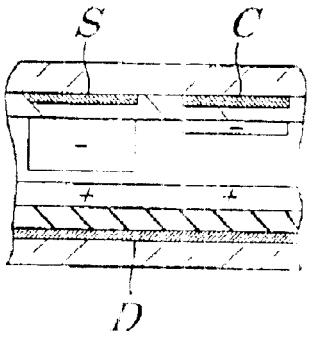
Figure 2D:
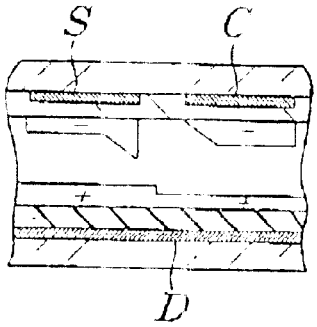
Figure 2C:
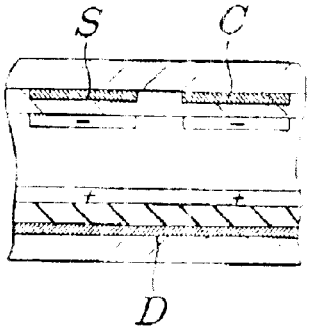
Figure 2E:
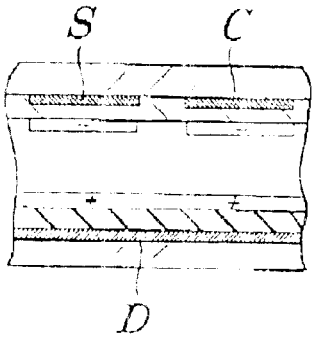

In a display cell where no sustaining discharge has occurred in the previous sub-field 1, on the other hand, as shown in FIG. 2E, two negative charges having almost the same magnitude are formed over the scanning electrode S and the common electrode C respectively, while the positive wall charge 35 is formed over the data electrode D. Accordingly, little wall voltage is generated yet at an interface gap.

In such a state, time shifts from the previous sub-field 1 into the sustaining erasing period 2. The sustaining erasing period 2 is made up of a first sustaining erasing period 2*a* and a second sustaining erasing period 2*b*. In the first sustaining erasing period 2*a*, a positive-polarity potential with respect to the data electrode D is applied to both the scanning electrode S and the common electrode C. In this case, a potential difference between the scanning electrode S and the common electrode C (inter-face potential difference) is supposed to be less than the surface-firing voltage (for example, 240V) but not less than a value (240−170=70V) obtained by subtracting a wall voltage (for example, 170V in the present embodiment) formed at the inter-face gap in the display cell which has been lit up in the previous sub-field 1 from the surface-firing voltage (for example, 240V in the present embodiment) (see FIG. 2A). Accordingly, in a display cell where sustaining discharge has occurred in the previous sub-field 1, the above-mentioned wall voltage is superimposed on a potential difference across the inter-face gap to thereby generate surface discharge, whereas in a display cell where no sustaining discharge has occurred in the previous sub-field 1, surface discharge does not occur. Specifically, a positive-polarity rectangular-pulse voltage Vse2 is applied to the scanning electrode S, while a negative-polarity rectangular-pulse voltage Vse1 1 is applied to the common electrode C. The data electrode D is biased to the ground potential. Vse1 is set to, for example, 170V and Vse2 is set to, for example, 320V. The potential difference across the interface gap, therefore, is Vse2−Vse1=320−170=150V. Note here that the data electrode is always biased to the ground potential in the preliminary discharge period 7.

As described above, in the display cell which has been lit up in the previous sub-field 1, the potential difference between the scanning electrode S and the common electrode C is Vse2−Vs1=150V, on which a wall voltage of 170V is superimposed, so that a total voltage of about 320V is applied to the surface-discharge gap. As a result, this voltage exceeds the surface-firing voltage of 240V, thus generating surface discharge. In this case, as shown in FIG. 2B, this surface discharge causes a negative wall charge to build up over both the scanning electrode S and the common electrode C. An amount of the negative wall charge over the scanning electrode S, however, is larger than that over the common electrode C, so that a wall voltage of the inter-face gap is 150V. Furthermore, this surface discharge causes a total wall voltage nearly equal to Vse2 (=320V) to occur between the scanning electrode S and the data electrode D (at the opposed gap).

In the display cell which has not been lit up in the previous sub-field 1, on the other hand, as shown in FIG. 2E, almost the same negative wall voltages are already formed over the scanning electrode S and the common electrode C respectively, so that no wall voltage is superimposed. Therefore, a potential difference between the scanning electrode S and the common electrode C remains at Vse2−Vse1=150V, which is less than 240V, so that surface discharge does not occur.

In such a state as shown in FIG. 2B, a negative wall charge formed over the scanning electrode S is too large in amount, so that error discharge occurs at the opposed gap when the potential of the scanning electrode S decreases to the ground potential in the later-described scanning period 5 and sustaining period 6. Therefore, opposed discharge is generated in the second sustaining erasing period 2*b* to thereby adjust an amount of the negative wall charge over the scanning electrode S. Specifically, the potential of the scanning electrode S is decreased to potential Vse4 and that of the common electrode C is set to potential Vse3. A magnitude of potential Vse4 is supposed to be such that opposed discharge may occur in a display cell where surface discharge has occurred in the first sustaining erasing period 2*a* but not occur in a display cell where surface discharge has not occurred therein. That is, a value of Vse2−Vse4 is set to at least the opposed-firing voltage (for example, 160V in the present embodiment). For example, Vse3 is set to 150V and Vse4 is set to 100V. Therefore, Vse2−Vse4=220V, thus generating opposed discharge. This opposed discharge thus generated decreases a negative wall voltage over the scanning electrode S and a positive wall voltage over the data electrode D. However, since the potential of the scanning electrode S is positive with respect to that of the data electrode D, a negative wall voltage and a positive wall voltage are left over the scanning electrode S and the data electrode D respectively. Furthermore, by biasing the common electrode to a positive potential Vse3 (=150V), it is possible to leave a negative wall voltage also over the common electrode C.

Note here that in a display cell where sustaining discharge has not occurred in the previous sub-field 1 and, therefore, surface discharge has not occurred in the first sustaining erasing period 2*a*, as shown in FIG. 2E, a negative wall charge is formed already over both the scanning electrode S and the common electrode C, so that opposed discharge does no occur even it a positive potential is applied to the scanning electrode S and the common electrode C.

As a result, at the end of the sustaining erasing period 2, a wall-charge arrangement in the display cell is such that, as shown in FIG. 2C, negative wall charges having almost the same magnitude are formed over the scanning electrode S and the common electrode C respectively and a positive wall charge is formed over the data electrode D. This wall charge arrangement is the same as that of a display cell which has not been lit up in the previous sub-field 1 as shown in FIG. 2E. That is, in the sustaining erasing period 2, it is possible to eliminate a difference in wall charge arrangement between the display cells caused by the condition of the previous sub-field 1, thus initializing the display cells.

Figure 9:
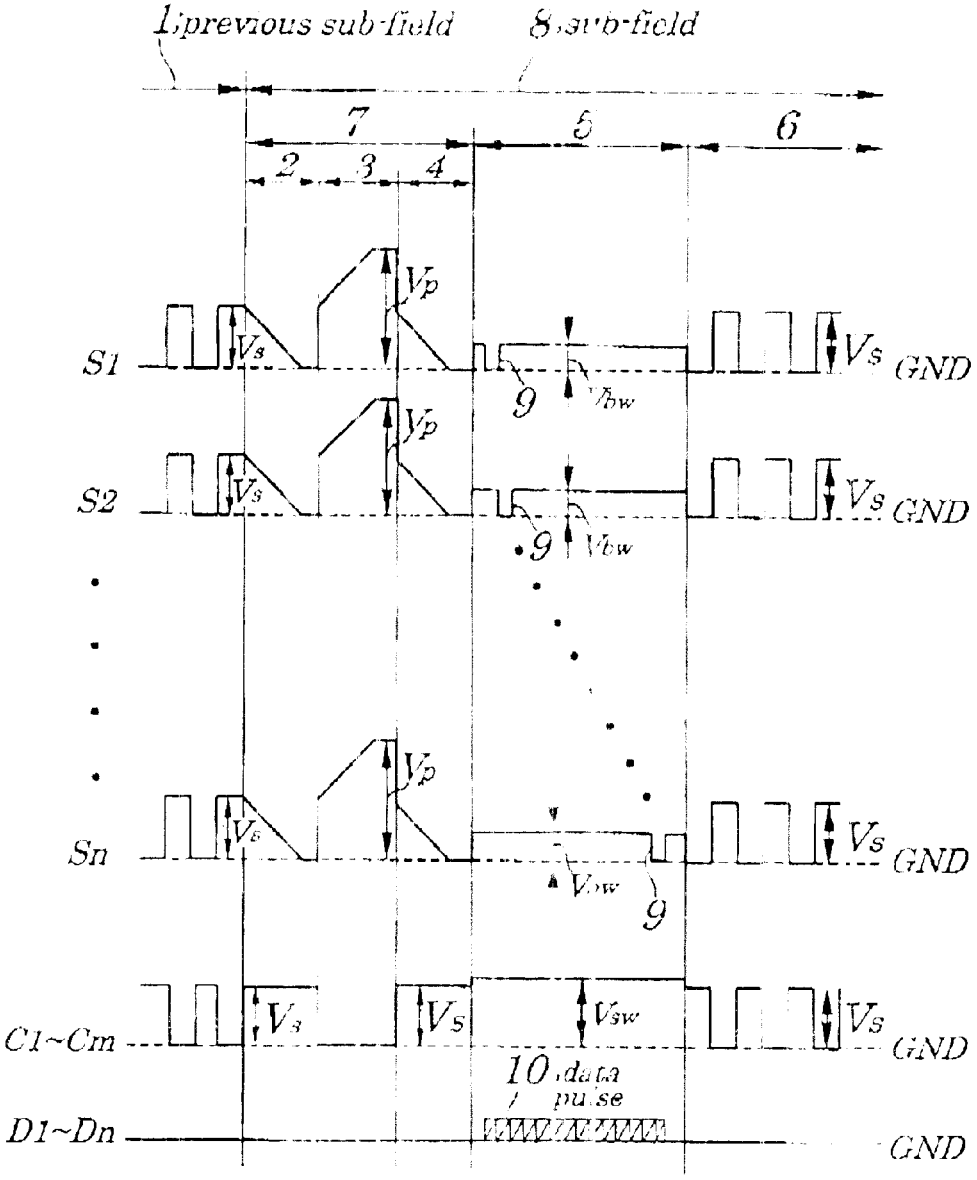
FIG.9 (PRIOR ART)
FIG. 9 is a waveform diagram for showing a method for driving a conventional three-electrode AC-type plasma display panel.

Hereafter, the same procedures as those of the conventional PDP driving method shown in FIG. 9 are performed in the priming period 3, the priming erasing period 4, the scanning period 5, and the sustaining period 6.

In the priming period 3, to enable generating write-in discharge at a low voltage in the following procedure, priming discharge is generated to obtain the priming effect. As shown in FIG. 1, the common electrode C is biased to the ground potential. The potential of the scanning electrode S, on the other hand, is continuously increased from potential Vse3 to higher voltage Vp1. That is, a voltage of a positive-polarity ramp waveform is applied to the scanning electrode S. Vp1 is, for example, 360 to 400V. Therefore, the scanning electrode S becomes of a positive polarity with respect to the common electrode C and the data electrode D, so that a voltage higher than the surface-firing voltage is applied at a gap (inter-face gap) between the scanning electrode S and the data electrode D and a voltage higher than the opposed-firing voltage is applied at the opposed gap between the scanning electrode S and the data electrode D. Accordingly, in every display cell, feeble priming discharge occurs at the inter-face gap and the opposed gap. This priming discharge causes a discharge gas in the display cell to be electrolytically dissociated to thereby supply a positive ion and an electron into the display cell, so that discharge occurs easily in the later-described scanning period 5 and sustaining period 6. When the priming discharge has thus occurred, resultantly a wall charge arrangement in the display cell becomes such that, as shown in FIG. 2D, an amount of a negative wall charge over the common electrode C decreases near the surface discharge gap and an amount of a negative wall charge over the scanning electrode S increases overall, especially near the surface discharge gap, while an amount of a positive wall charge increases in such a region over the data electrode D as to be opposite to the scanning electrode S.

In the priming erasing period 4, the common electrode C is supposed to be biased to the potential Vs. Furthermore, the potential of the scanning electrode S is once decreased to the potential Vs non-continuously and then from the potential Vs to the ground potential continuously. Accordingly, opposite to the above-mentioned priming period 3, the common electrode C becomes positive in polarity with respect to the scanning electrode S. Therefore, feeble discharge opposite to the above-mentioned priming discharge, that is, a priming erasing current occurs at the inter-face gap to enable erasing a wall charge formed by the priming discharge. As a result, a wall charge arrangement in the display cell becomes such as shown in FIG. 2E. The wall charge arrangement shown in FIG. 2E is the same as that shown in FIG. 2C, that is, a wall charge arrangement before the priming discharge. Then, the preliminary discharge period 7 ends. Note here that the above-mentioned ramp waveform has a width of about 40 to 80 $\mu$s.

In the scanning period 5, as by the conventional driving method, the positive potential Vbw is applied to the scanning electrode S and the positive potential Vsw is applied to the common electrode C. The potential Vbw is set to, for example, about 50 to 100V and the potential Vsw is set to, for example, about 170 to 190V. In such a state, a negative scanning pulse 9 decreasing in potential to the ground potential is applied to the scanning electrodes S1 through Sm sequentially. In synchronization with this scanning pulse 9 in timing, a data pulse 10 is selectively applied to the data electrodes D1 through Dn based on display data. A voltage of the data pulse 10 is set to, for example, 60 to 70V. At a picture cell to which the data pulse 10 is applied, a total voltage of the scanning pulse 9 and the data pulse 10 is applied at a gap (opposed gap) between the scanning electrode S and the data electrode D. Since this total voltage reaches the opposed-firing voltage or more, write-in discharge occurs at the opposed gap.

Figure 10A:
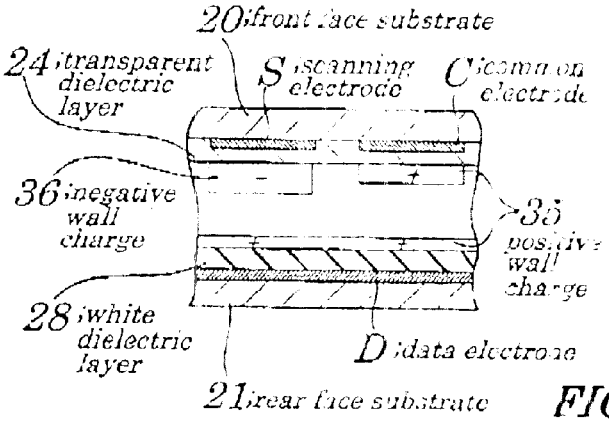
FIG. 10A (PRIOR ART)
FIGS. 10A to 10E are schematic cross-sectional views for showing a method for driving the PDP of FIG. 9.
Figure 10B:
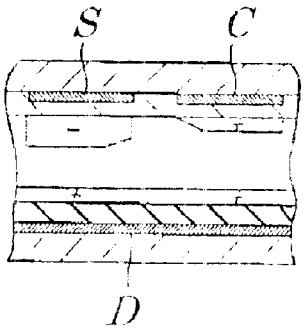
FIG. 10B (PRIOR ART)
Figure 10C:
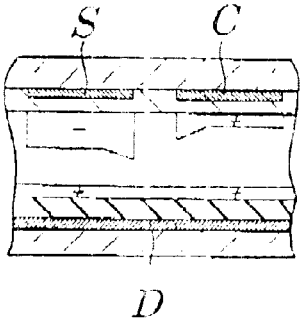
FIG. 10C (PRIOR ART)
Figure 10D:
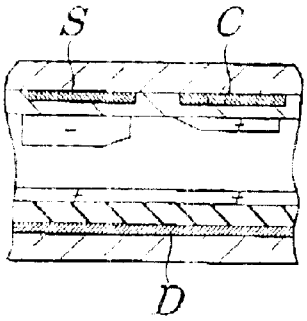
FIG. 10D (PRIOR ART)

Note here that by the conventional PDP driving method, as shown in FIG. 10D, a positive wall charge is already formed over the common electrode C, so that a charge moves also at a gap (inter-face gap) between the scanning electrode S and the common electrode C when write-in discharge occurs. By the present embodiment, on the other hand, a negative wall charge is already formed over the common electrode C as well as over the scanning electrode S, so that no charge moves at the inter-face gap when write-in discharge occurs.

Figure 10E:
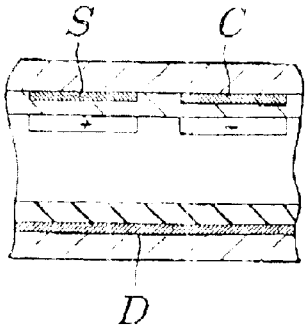
FIG. 10E (PRIOR ART)

In a display cell where write-in discharge has occurred, as shown in FIG. 10E, the scanning electrode S is of a negative polarity, so that a positive wall charge builds up over the scanning electrode S. Furthermore, since the common electrode C is biased to a positive-polarity potential, a negative wall charge builds up over the common electrode C. Moreover, the data electrode D is positive in polarity with respect to the scanning electrode S but negative with respect to the common electrode C, so that a wall charge builds up little over the data electrode D.

In a display cell to which the data pulse 10 is not applied, on the other hand, application of the scanning pulse 9 alone is not enough for a potential difference across the opposed gap to reach the opposed-firing voltage, so that write-in discharge does not occur. Therefore, a wall charge condition remains unchanged in such a wall charge arrangement as shown in FIG. 2E. Thus, it is possible to create two wall charge conditions for each of the display cells by applying and not applying the data pulse 10. In a hatched portion of the data pulse 10 in FIG. 9, the data pulse 10 may be applied or not applied according to display data.

When the scanning pulse 9 has been applied to all of the scanning electrodes S (Sl–Sm) the sustaining period 6 is entered. In the sustaining period 6, a driving method and a wall charge arrangement are the same as those by the conventional driving method. That is, only when write-in discharge has occurred in the scanning electrode 5, sustaining discharge occurs to light up a relevant display cell. It is thus possible to control whether the display cell is to be lit up or not.

The above-mentioned preliminary period 7, scanning period 5, and sustaining period 6 are combined to make up the sub-field 8. To display an image on a PDP, gradation of the image can be displayed by providing one sub-field or a plurality of sub-fields in one field which is a period for displaying image information of one screen and, if the field has more than one sub-field, providing mutually different numbers of sustaining pulses in the plurality of sub-fields to thereby select whether each of these sub-fields is to be lit up or not in order to control the number of times of generating sustaining discharge.

As described above, by the present embodiment, at the end of the sustaining erasing period 2, as shown in FIG. 2C, a negative wall charge can be formed over the scanning electrode S and the common electrode C. Accordingly, it is possible to prevent charge movement due to write-in discharge in the scanning period 5. As a result, power dissipation can be reduced.

Specifically, in contrast to the conventional driving method by which a peak current of about 200 $\mu$A flows in each display cell owing to write-in discharge, the present embodiment can reduce the peak current to about 130 $\mu$A.

Second Embodiment

Figure 3:
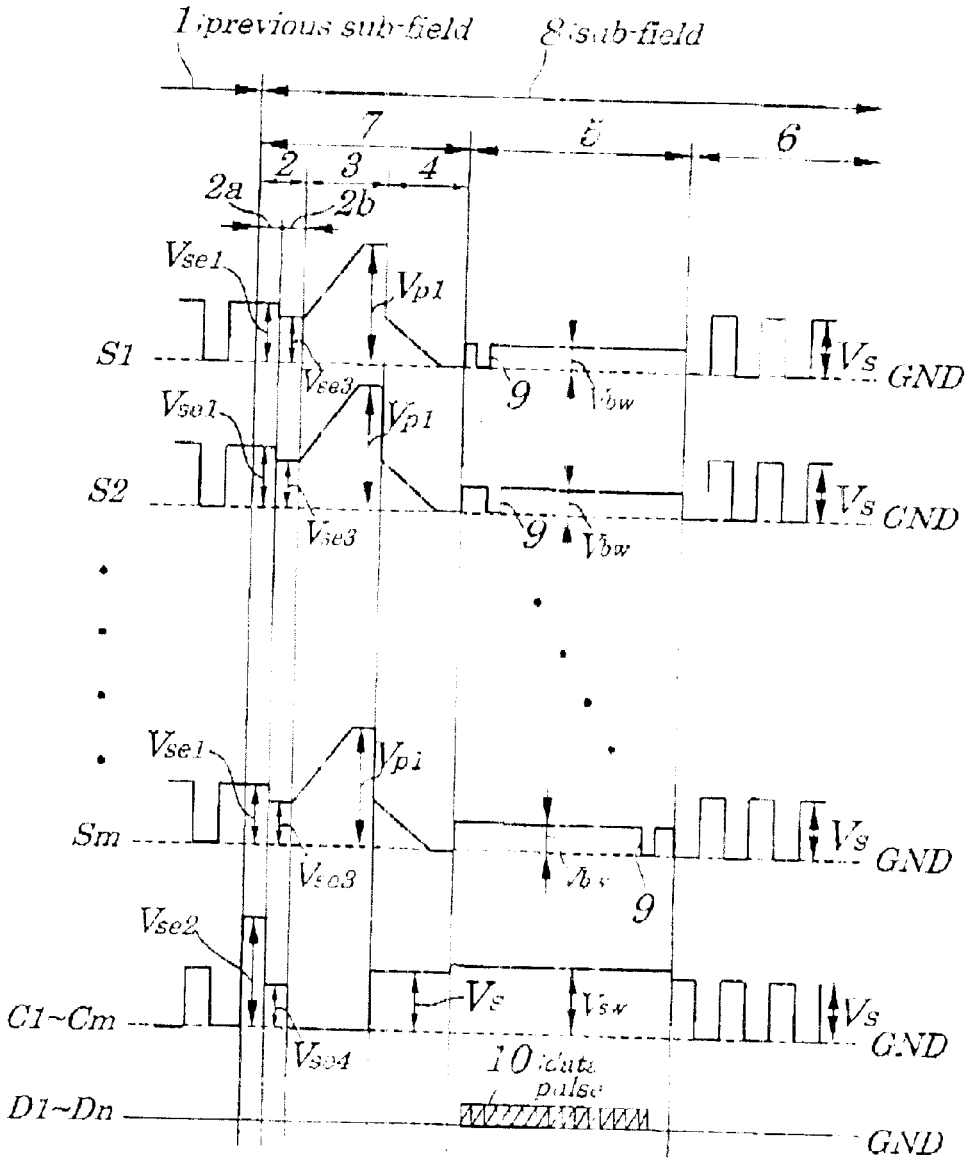
FIG. 3 is a waveform diagram for showing a method for driving a PDP related to a second embodiment of the present invention.

The following will describe a second embodiment of the present invention. FIG. 3 is a waveform diagram for showing a method for driving a PDP related to the second embodiment of the present invention. The PDP related to the present embodiment has the same configuration as that of the above-mentioned PDP related to the first embodiment.

As compared to the above-mentioned first embodiment, the PDP driving method related to the present embodiment reverses a polarity of the last sustaining pulse in the previous sub-field 1. To do so, the present embodiment specifically makes a polarity of a driving waveform applied to the scanning electrode S and that of a driving waveform applied to the common electrode C opposite to each other. That is, in the second embodiment, in the sustaining erasing period 2, a driving waveform applied to the common electrode C in the above-mentioned first embodiment is applied to the scanning electrode S, while a driving waveform applied to the common electrode S in the above-mentioned first embodiment is applied to the common electrode C. The other processes of the second embodiment other than the above are the same as those of the PDP driving method related to the above-mentioned first embodiment. Therefore, in a wall charge arrangement by the present embodiment in the sustaining erasing period 2, the scanning electrode S and the common electrode C are replaced with each other in FIGS. 2A to 2C. Furthermore, the present embodiment provides the same actions and effects as those by the above-mentioned first embodiment.

Third Embodiment

Figure 4:
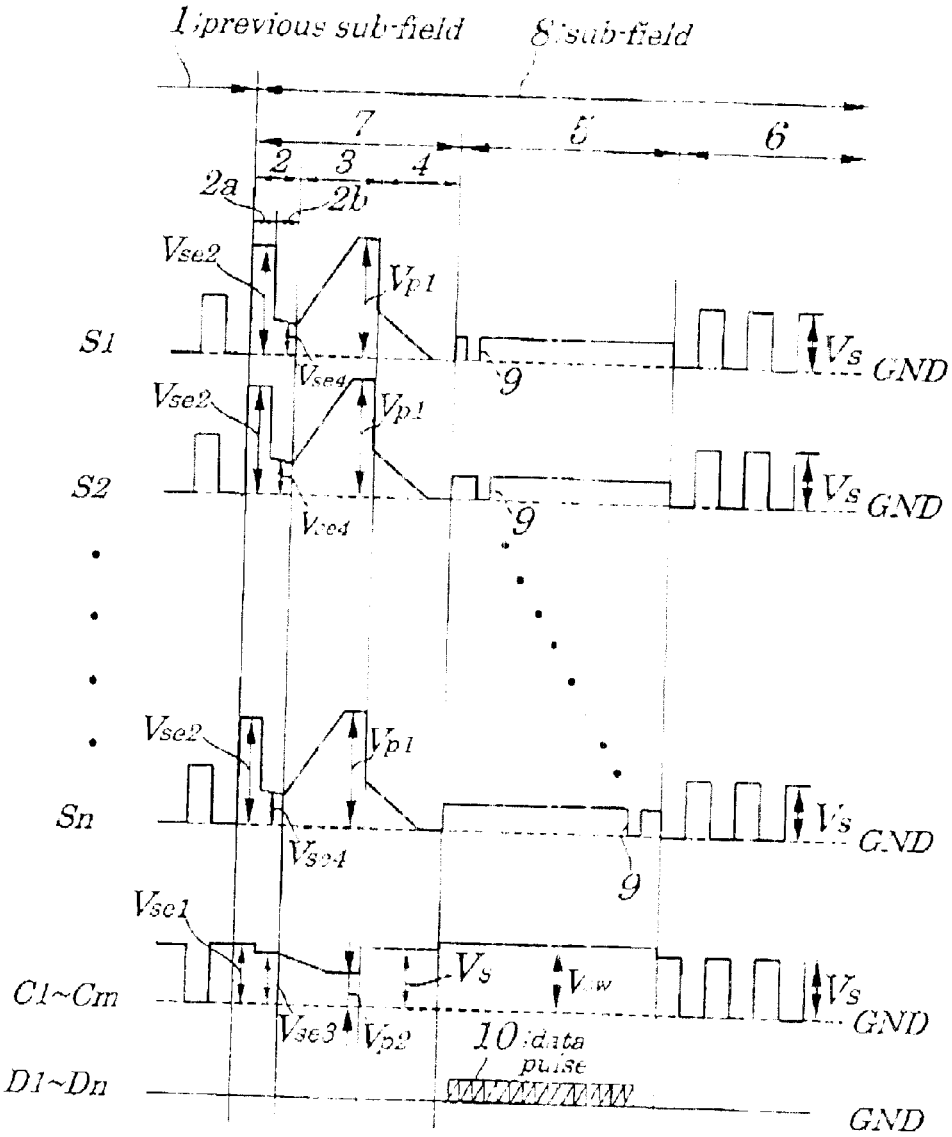
FIG. 4 is a waveform diagram for showing a method for driving a PDP related to a third embodiment of the present invention.

The following will describe the third embodiments of the present invention. A PDP related to the present embodiment has the same configuration as the above-mentioned first embodiment. As in FIGS. 2A to 2E, in FIGS. 5A to 5E too, the positive wall charge 35 and the negative wall charge 36 are shown in a polygon, while a height of the positive and negative wall charges 35 and 36 indicates a magnitude of a wall voltage, which is a potential difference generated by a wall charge on the dielectric layer. A reference symbol S indicates the scanning electrode, a reference symbol C indicates the common electrode, and a reference symbol D indicates the data electrode. As shown in FIG. 4, as in the case of the above-mentioned first embodiment, by the PDP driving method related to the third embodiment too, each field is made up of one or a plurality of sub-fields, the sub-field 8 of which is made up of the preliminary discharge period 7, the scanning period 5, and the sustaining period 6. Furthermore, the preliminary discharge period 7 is made up of the sustaining erasing period 2, the priming period 3, and the priming erasing period 4. Furthermore, the sustaining erasing period 2 is made up of the first sustaining erasing period 2*a* and the second sustaining erasing period 2*b*. The PDP driving method of the present embodiment is the same as that of the above-mentioned first embodiment except the priming period 3. The driving method, therefore, is not detailed except the priming period 3.

Figure 5A:
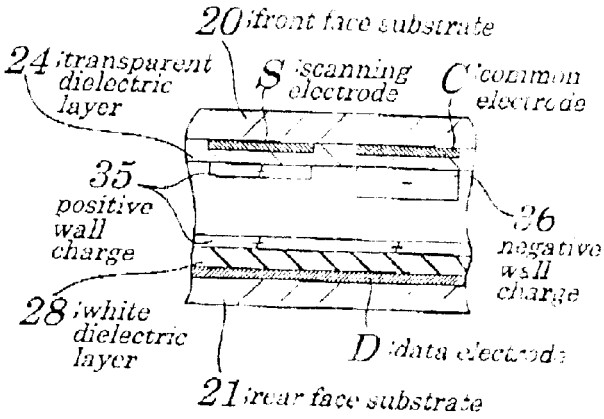
FIGS. 5A to 5E are schematic cross-sectional views for showing a method for driving the PDP of FIG. 4.

A driving waveform and a wall charge arrangement in the sustaining erasing period 2 of the preliminary discharge period 7 are the same as those by the above-mentioned first embodiment. That is, in a display cell which has been lit up in the previous sub-field 1 at the beginning of the sustaining erasing period 2, an electric field in the display cell is uniform because it has such a wall charge arrangement that a positive wall charge is formed over the scanning electrode S and the data electrode D and a negative wall charge is formed over the common electrode C as shown in FIG. 5A. A display cell which has not been lit up in the previous sub-field 1, on the other hand, has such a wall charge arrangement that a negative wall charge is formed over the scanning electrode S and the common electrode C and a positive wall charge is formed over the data electrode D as shown in FIG. 5E.

Figure 5B:
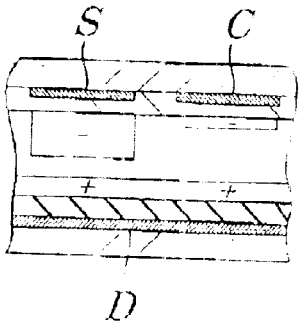
Figure 5C:
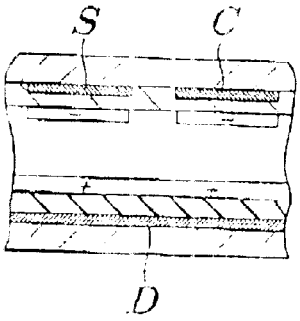

Afterwards, in the first sustaining erasing period 2*a*, a potential positive with respect to that of the data electrode D is applied to the scanning electrode S and the common electrode C to thereby generate surface discharge, thus providing the display cell which has been lit up in the previous sub-field 1 with such a wall charge arrangement that a larger negative wall charge is formed over the scanning electrode S, a negative wall charge smaller in magnitude than that over the scanning electrode S is formed over the common electrode C, and a positive wall charge is formed over the data electrode D as shown in FIG. 5B. Next, in the second sustaining erasing period 2*b*, the potential of the scanning electrode S is decreased by a potential difference not less than the opposed-firing voltage, thus providing the display cell which has not been lit up in the previous sub-field 1 with such a wall charge arrangement that negative wall charges having almost the same magnitude are formed over the scanning electrode S and the common electrode C respectively and a positive wall charge is formed over the data electrode D as shown in FIG. 5C. As a result, at the end of the sustaining erasing period 2, the display cells have such a wall charge arrangement as shown in FIG. 5C independently of whether they have been light up or not in the previous sub-field 1.

In the priming period 3, a potential applied to the common electrode C is continuously changed from Vse4 to Vp2, while at the same time a potential applied to the scanning electrode S is continuously increased from Vse3 to Vp1 higher than Vse3 and Vp2. That is, a ramp waveform having a positive polarity is applied to the scanning electrode S and the common electrode C to gradually turn the potential of the scanning electrode S positive with respect to those of the common electrode C and the data electrode D. In this case, a value of the potential Vp1 is such that a difference thereof from the ground potential may be not less than the opposed-firing voltage and a difference thereof from the potential Vp2 may be less than the surface-firing voltage. This makes it possible to generate feeble discharge, as priming discharge, mainly at a gap (opposed gap) between the scanning electrode S and the data electrode D and suppress surface discharge at a gap (inter-face gap) between the scanning electrode S and the common electrode C. As compared to surface discharge, opposed discharge has a small influence on luminance of the screen, so that it is possible to suppress surface discharge to thereby suppress light emission due to priming discharge, thus reducing black luminance.

Specifically, the potential Vp1 is set to, for example, 360 to 400V. In this case, if the common electrode C is assumed to be biased to the ground potential, feeble discharge occurs at the opposed gap and the inter-face gap. However, as the voltage Vp2 applied to the common electrode C increases, the intensity of surface discharge decreases. If a value of Vp1−Vp2 is set to not more than 240V, which is the surface-firing voltage, spread of discharge at the surface discharge gap disappears, thus providing opposed discharge mainly. If priming discharge becomes feeble at the opposed gap mainly, spread of the discharge at the surface discharge gap disappears, thus decreasing the luminance of the priming discharge. If Vp1=380V and Vp2=140V, then Vp1−Vp2=240V, so that discharge becomes opposed discharge mainly, thus decreasing luminance. This decrease in luminance makes it possible to decrease the luminance in black display, thus improving the contrast of an image. In this priming discharge, however, surface discharge occurs a little. At the opposed-discharge portion in priming discharge, the scanning electrode S becomes of a positive polarity, so that if the priming discharge is composed of only opposed discharge, there occurs no secondary electron emission due to collision of a positive ion with the MgO film, thus destabilizing the discharge. Therefore, by generating surface discharge a little, priming discharge can be stabilized.

Figure 5D:
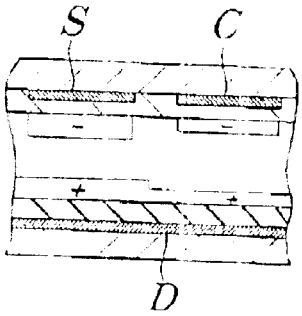
Figure 5E:
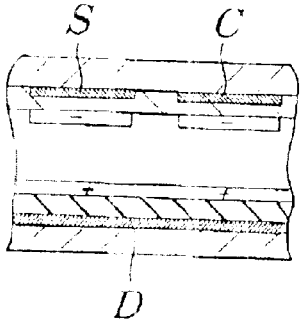

Note here that when this technology of increasing Vp2 is applied to the conventional driving waveform shown in FIG. 9, the priming effect becomes insufficient, so that display flickers. Such a decrease in black luminance can be realized only by combining it with a driving waveform at a maintenance erasing portion of the present embodiment. A wall charge arrangement in a display cell at the end of the priming period 3 is such that, as shown in FIG. 5D, an amount of a negative wall charge over the scanning electrode S is increased and an amount of a positive wall charge in such a region over the data electrode D as to be opposite to the scanning electrode S is increased as compared to such a wall charge arrangement before occurrence of priming discharge as shown in FIG. 5C.

In the priming erasing period 4, such a procedure is performed as to return the condition of the wall charge generated by priming discharge roughly to that before occurrence of the priming discharge. That is, the potential of the scanning electrode S is non-continuously decreased to a potential whose potential difference from the potential Vp1 is less than the opposed-firing voltage and then decreased from this potential to the ground potential continuously. The potential of the common electrode C, on the other hand, is supposed to be the potential Vs. Accordingly, between the scanning electrode S and the data electrode D, feeble discharge (priming erasing discharge) occurs in a direction opposite to that of the above-mentioned priming discharge, so that a wall charge formed by the priming discharge can be erased. As a result, such a wall charge arrangement is provided in the display cell as shown in FIG. 5E. The wall charge arrangement shown in FIG. 5E is the same as that shown in FIG. 5C, that is, a wall charge arrangement before the priming discharge. Then, the preliminary discharge period 7 ends. Note here that the above-mentioned ramp waveform has a width of 40 to 80 $\mu$s.

In the scanning period 5 and the sustaining period 6, a driving method and a wall charge arrangement are the same as those by the above-mentioned first embodiment. That is, in the scanning period 5, sustaining discharge is generated selectively in the display cells based on display data, while in the sustaining period 6, sustaining discharge is generated only in a display cell where write-in discharge has occurred in the scanning period 5. Thus, an image can be displayed.

By the present embodiment, at the end of the sustaining erasing period 2, as shown in FIG. 5C, a negative wall charge can be formed over the scanning electrode S and the common electrode C. Accordingly, it is possible to prevent a charge from moving between the scanning electrode S and the common electrode C, thus reducing power dissipation.

Furthermore, in the priming period 3, a proportion of surface discharge in priming discharge can be reduced to decrease luminance of the priming discharge. It is thus possible to reduce black luminance of the PDP, thus improving the contrast of an image.

Specifically, in contrast to the conventional driving method by which a peak current of about 200 $\mu$A flows in each display cell owing to write-in discharge, the present embodiment can reduce the peak current to about 130 $\mu$A. Furthermore, by eliminating surface discharge in priming discharge, a conventional black luminance value of about 0.8 cd/m$^2$ can be reduced to 0.18 cd/m$^2$ or less if each field (60 Hz) is made up of twelve sub-fields.

Fourth Embodiment

Figure 6:
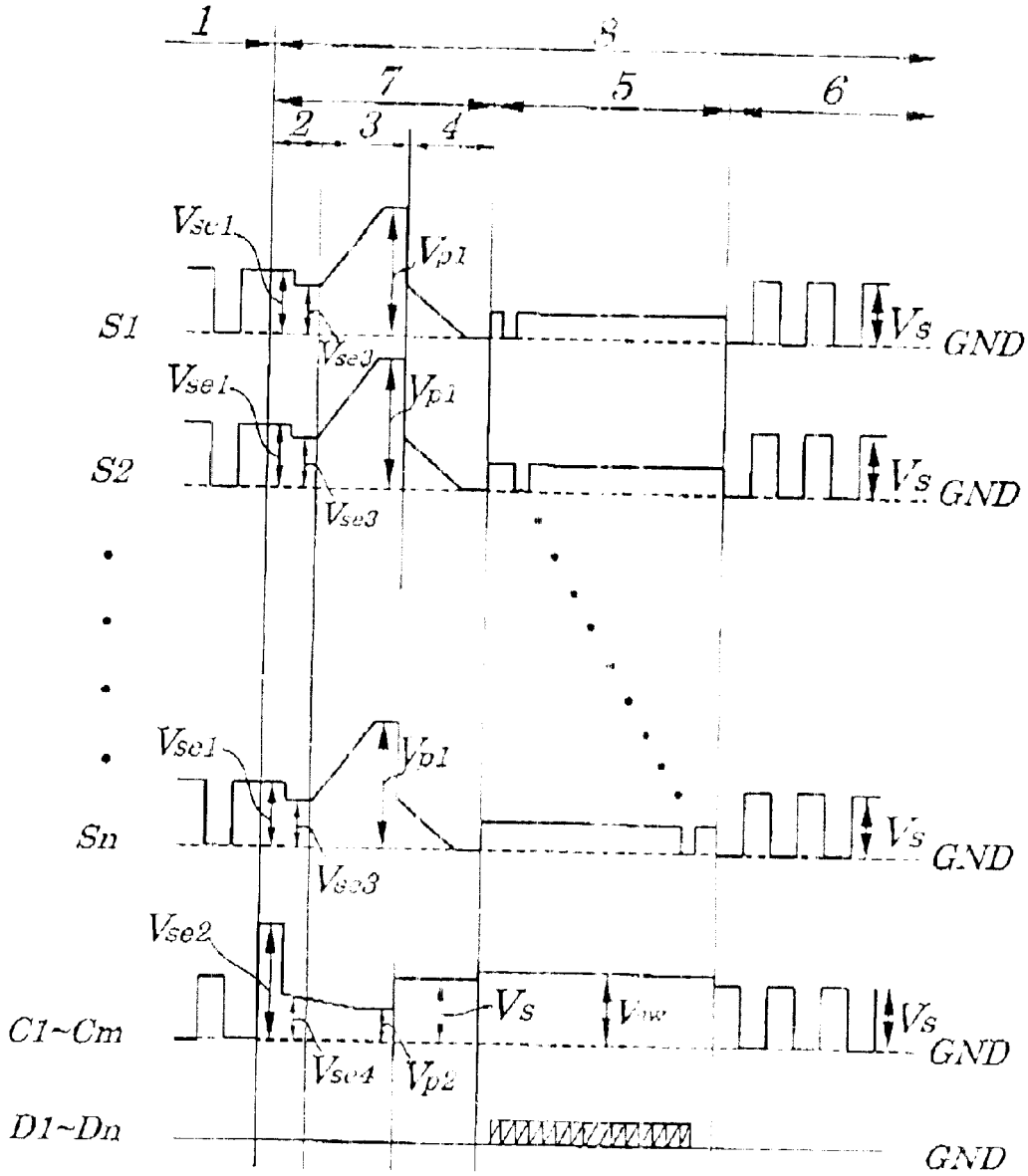
FIG. 6 is a waveform diagram for showing a method for driving a PDP related to a fourth embodiment of the present invention.

The following will describe a fourth embodiment of the present invention. FIG. 6 is a waveform diagram for showing a method for driving a PDP related to the fourth embodiment of the present invention. A configuration of the PDP related to the present embodiment is the same as that of the PDP related to the above-mentioned first through third embodiments.

The PDP driving method related to the fourth embodiment differs from the above-mentioned third embodiment in a respect that the polarity of the last sustaining pulse in the previous sub-field 1 is reversed. In the sustaining erasing period 2, therefore, a driving waveform applied to the scanning electrode S is made opposite to a driving waveform applied to the common electrode C. That is, by the present fourth embodiment, in the sustaining erasing period 2, a driving waveform applied to the common electrode C in the above-mentioned third embodiment is applied to the scanning electrode S, while a driving waveform applied to the scanning electrode S in the above-mentioned third embodiment is applied to the common electrode C. The other processes of this PDP driving method of the present fourth embodiment are the same as those of the PDP driving method related to the above-mentioned third embodiment. Therefore, in a wall charge arrangement in the sustaining erasing period 2, the scanning electrode S and the common electrode C are replaced with each other in FIGS. 5A to 5C. Furthermore, the present embodiment provides the same actions and effects as those by the above-mentioned third embodiment.

Although the above-mentioned first through fourth embodiments have used a PDP which has a surface-firing voltage of about 240V and an opposed-firing voltage of about 160V, the PDP of the present invention is not limited thereto. Also, although the above-mentioned first through fourth embodiments have used such a PDP as to have a configuration shown in FIGS. 6 and 7, the PDP of the present invention is not limited thereto. Furthermore, although in the above-mentioned first through fourth embodiments, the data electrode D has been biased to the ground potential in the preliminary discharge period 7 and the sustaining period 6, the present invention is not limited thereto. Even furthermore, although in the above-mentioned first through fourth embodiments, driving waveforms have all been of a positive polarity, the present invention is not limited thereto; for example, the driving waveform may include both a negative-polarity driving waveform or a positive-polarity voltage and a negative-polarity voltage.

EXAMPLES

The following will describe effects of the present invention specifically. First, the present inventor has made a testing PDP which has a screen size of 2 inches×2 inches and 50×150 display cells. This testing PDP has almost the same PDP display cell construction as that related to the above-mentioned first embodiment. In the present testing PDP, however, the surface-firing voltage has been set to about 220V and the opposed-firing voltage, to about 175V. Accordingly, the surface discharge gap has been set to about 70 $\mu$m and the opposed discharge gap, to about 100 $\mu$m. The size of the display cell has been set to 0.81 mm vertically and 0.27 mm horizontally. Furthermore, since the present testing PDP has been made to measure basic characteristics, it is different from a commercial product PDP related to the first embodiment, so that its parts not related to driving characteristics so much have been omitted in configuration. For example, the present testing PDP is not provided with a front face filter arranged on a display face side in the product PDP in order to guard against EMI and reduce black luminance. Furthermore, in contrast to the product PDP in which a phosphor layer of each display cell is painted in three colors of RGB (read, green, and blue), in the present testing PDP, all the display cells are each provided with a green phosphor. Accordingly, the present testing PDP has almost the same voltage applied to the display cells as that of the PDP exemplified in the above-mentioned first embodiment but a different ratio of utilizing emitted light. Therefore, an absolute value of black luminance listed in Table 1 is somewhat different from that of the PDP given in the above-mentioned first embodiment.

The present inventor has driven such a testing PDP using such a driving waveform as shown in the above-mentioned third embodiment to measure black luminance. As shown in Table 1, with a decreasing value of Vp1–Vp2, the black luminance has decreased. This is considered because surface discharge has occurred little in the priming period.

TABLE 1

| | | Vp1 (V) | | | |
|---|---|---|---|---|---|
| | | 370 | 380 | 390 | 400 |
| Vp2 (V) | 0 | 4.15 | 4.38 | 4.49 | 4.78 |
| | 20 | 4.17 | 4.50 | 4.72 | 5.01 |
| | 40 | 3.35 | 4.08 | 4.62 | 4.97 |
| | 60 | 1.86 | 2.42 | 3.16 | 4.03 |
| | 80 | 0.82 | 1.80 | 2.51 | 2.92 |
| | 100 | 0.69 | 1.11 | 2.17 | 2.82 |
| | 110 | 0.58 | 1.11 | 1.75 | 2.68 |
| | 120 | 0.54 | 1.10 | 1.48 | 2.54 |
| | 130 | 0.09 | 1.06 | 1.08 | 2.37 |
| | 140 | 0.07 | 0.09 | 0.77 | 2.22 |
| | 150 | 0.07 | 0.08 | 0.12 | 2.10 |
| | 160 | 0.06 | 0.08 | 0.10 | 0.06 |

(Unit: cd/m$^2$)

As detailed above, by the present invention, it is possible to decrease a write-in discharge current in write-in operation to reduce power dissipation of a scanning driver when driving a plasma display panel. It is also possible to suppress surface discharge in priming discharge and priming erasing discharge, thus reducing black luminance of a PDP.

It is thus apparent that the present invention is not limited to the above embodiments and examples but may be changed and modified without departing from the scope and spirit of the invention.

What is claimed is:

1. An AC-type plasma display panel comprising: a first insulation substrate and a second insulation substrate arranged opposite each other, a plurality of scanning electrodes and a plurality of common electrodes alternatively arranged on an opposition surface of said first insulation substrate to said second insulation substrate in a first direction, a plurality of data electrodes arranged on an opposition side of said second insulation substrate to said first insulation substrate in a second direction perpendicular to said first direction, a first dielectric layer formed to cover said plurality of scanning electrodes and said plurality of common electrodes, a second dielectric layer formed to cover said plurality of data electrodes, a plurality of discharge gaps arranged between said scanning electrodes and said common electrodes, and a plurality of picture cells each of which includes one of cross points of said discharge gaps and data electrodes;

wherein a surface-firing voltage between such a scanning electrode region as to correspond to a region over said scanning electrode and such a common electrode region as to correspond to a region over said common electrode on a surface of said first dielectric layer in said picture cell is higher than an opposed-firing voltage between each of said scanning electrode region and said common electrode region and such a region on a surface of said second dielectric layer as to correspond to a region over said data electrode.

2. The AC-type plasma display panel according to claim 1, wherein a difference between said surface-firing voltage and said opposed-firing voltage is 50 to 120V.

3. An AC-type plasma display panel driving method for driving, based on display data, an AC-type plasma display panel comprising: a first insulation substrate and a second insulation substrate arranged opposite each other, a plurality of scanning electrodes and a plurality of common electrodes alternatively arranged on an opposition surface of said first insulation substrate to said second insulation substrate in a first direction, a plurality of data electrodes arranged on an opposition side of said second insulation substrate to said first insulation substrate in a second direction perpendicular to said first direction, a first dielectric layer formed to cover said plurality of scanning electrodes and said plurality of common electrodes, a second dielectric layer formed to cover said plurality of data electrodes, a plurality of discharge gaps arranged between said scanning electrodes and said common electrodes, and a plurality of picture cells each of which includes one of cross points of said discharge gaps and data electrodes;

said method comprising the steps of:

sub-dividing each of fields which displays one image into one or a plurality of sub-fields, said one or plurality of sub-fields having a preliminary discharge period for initializing a charge condition in each of said picture cells, a scanning period for forming a wall charge selectively in said picture cells based on said display data, and a sustaining period for applying a voltage to said scanning electrode and said common electrode alternately to thereby generate sustaining discharge, in the picture cell where said wall charge is formed, between a scanning electrode region which corresponds to a region over said scanning electrode and a common electrode region which corresponds to a region over said common electrode on said surface of said first dielectric layer; and forming a negative wall charge in both said scanning electrode region and said common electrode region in said preliminary discharge period.

4. The AC-type plasma display panel driving method according to claim 3, wherein said preliminary discharge period has a sustaining erasing period for initializing a charge condition in each of said picture cells, in which sustaining erasing period a negative wall charge is formed in both said scanning electrode region and said common electrode region.

5. The AC-type plasma display panel driving method according to claim 4, wherein, in at least one sub-field of said sub-fields, said preliminary discharge period has a priming period for generating priming discharge in said picture cells to thereby make it easy to generate discharge in said picture cells and a priming erasing period for erasing a wall charge generated by said priming discharge.

6. The AC-type plasma display panel driving method according to claim 5, wherein, in said preliminary discharge period, said sustaining erasing period precedes in timing said priming period and said priming erasing period.

7. The AC-type plasma display panel driving method according to claim 4, wherein said sustaining erasing period is made up of a first sustaining erasing period and a second sustaining erasing period, said method further comprising the steps of:

in said first sustaining erasing period, applying respectively a potential to said scanning electrode and an other potential to said common electrode, said potential applied to said scanning electrode and said other potential applied to said common electrode being different from each other, and both higher than a potential applied to said data electrode, to thereby generate surface discharge between said scanning electrode region and said common electrode region in order to form a negative wall charge in said scanning electrode region and said common electrode region; and in said second sustaining erasing period, generating opposed discharge between said scanning electrode region or said common electrode region and such a data electrode region on said surface of said second dielectric layer as to correspond to a region over said data electrode to thereby adjust an amount of a wall charge in said scanning electrode region, said common electrode region, and said data electrode region in such a manner that a magnitude of a wall voltage generated by said wall charge between said scanning electrode region and said data electrode region and a magnitude of a wall voltage generated between said common electrode region and said data electrode region may be less than an opposed-firing voltage between each of said scanning electrode region and said common electrode region and said data electrode region.

8. The AC-type plasma display panel driving method according to claim 7, wherein by said step of forming a negative wall charge in both of said scanning electrode region and said common electrode region in said first sustaining erasing period, a potential difference between said potential applied to said scanning electrode and said potential applied to said common electrode is set not less than a voltage obtained by subtracting from a surface-firing voltage between said scanning electrode region and said common electrode region a wall voltage generated between said scanning electrode region and said common electrode region owing to a wall charge formed by sustaining discharge in a sub-field immediately preceding a sub-field to which said first sustaining erasing period belongs and less than said surface-firing voltage.

9. The AC-type plasma display panel driving method according to claim 7, wherein by said step of adjusting an amount of a wall charge in said scanning electrode region, said common electrode region, and said data electrode region in said second sustaining erasing period, said potential applied to said scanning electrode or said potential applied to said common electrode whichever is higher in potential in said first sustaining erasing period is decreased by a potential difference not less than said opposed-firing voltage while sustaining said potential applied to said scanning electrode and said potential applied to said common electrode higher than said potential applied to said data electrode.

10. The AC-type plasma display panel driving method according to claim 7, wherein by said step of adjusting an amount of a wall charge in said scanning electrode region, said common electrode region, and said data electrode region in said second sustaining erasing period, a potential difference between said scanning electrode and said data electrode is set to a value less than said opposed-firing voltage and a potential difference between said common electrode and said data electrode is set to a value less than said opposed-firing voltage.

11. The AC-type plasma display panel driving method according to claim 5, further comprising the steps of:

in said priming period, continuously increasing a potential of either one of said scanning electrode and said common electrode from a first potential to a second potential which is higher than said first potential and whose potential difference from a potential of said data electrode is not less than said opposed-firing voltage and, at the same time, setting a potential of the other electrode to a third potential which is lower than said second potential and whose potential difference from said second potential is less than said surface-firing voltage; and in said priming erasing period, decreasing a potential of said either one electrode from said second potential to a fourth potential which is lower than said second potential and whose potential difference from a potential of said second potential is less than said opposed-firing voltage and then continuously decreasing said potential of said either one electrode from said fourth potential to said potential applied to said data electrode.

12. The AC-type plasma display panel driving method according to claim 11, wherein said potential applied to said data electrode is biased to a ground potential.

13. The AC-type plasma display panel driving method according to claim 3, wherein in said AC-type plasma display panel, said surface-firing voltage between said scanning electrode region and said common electrode region is higher than said opposed-firing voltage between each of said scanning electrode region and said common electrode region and such a data electrode region on said second dielectric layer surface as to correspond to a region over said data electrode.

14. The AC-type plasma display panel driving method according to claim 13, wherein a difference between said surface-firing voltage and said opposed-firing voltage is 50 to 120V.

15. An AC-type plasma display panel driving method for driving, based on display data, an AC-type plasma display panel comprising first and second insulation substrates which are arranged as opposed to each other, a plurality of scanning electrodes and a plurality of common electrodes which are alternately arranged on such a surface of said first insulation substrate as to face said second insulation substrate and which extend in a first direction, a first dielectric layer which covers said scanning electrodes and said common electrodes, a plurality of data electrodes which is provided on such a surface of said second insulation substrate as to face said first insulation substrate and which extends in a second direction perpendicular to said first direction, and a second dielectric layer which covers said data electrodes in such a configuration that picture cells are formed in a matrix in such a manner as to each have one nearest point between said data electrode and each of said scanning electrode and said common electrode and a surface-firing voltage between said scanning electrode region and said common electrode region is higher than an opposed-firing voltage between each of said scanning electrode region and said common electrode region and such a data electrode region on said surface of said second dielectric layer as to correspond to a region over said data electrode, each of fields which displays one image is subdivided into one or a plurality of sub-fields, said one or plurality of sub-fields having a preliminary discharge period for initializing a charge condition in each of said picture cells and also making occurrence of discharge easy, a scanning period for forming a wall charge selectively in said picture cells based on said display data, and a sustaining period for applying a voltage to said scanning electrode and said common electrode alternately to thereby generate sustaining discharge, in the picture cell where said wall charge is formed, between said scanning electrode region and said common electrode region, said preliminary discharge period having a sustaining erasing period for initializing a charge condition in each of said picture cells, a priming period for generating priming discharge in said picture cells to thereby make occurrence of discharge easy in said picture cells, and a priming erasing period for erasing the wall charge generated by said priming discharge, and said sustaining erasing period being made up of a first sustaining erasing period and a second sustaining erasing period, comprising the steps of:

in said first sustaining erasing period, applying the ground potential to said data electrode, a first positive potential to a first surface electrode which is said scanning electrode or said common electrode whichever has lower potential applied thereto at the end of a sub-field immediately preceding a sub-field to which said first sustaining erasing period belongs, and a second positive potential which is less than said first positive potential, whose potential difference from said first positive potential is not less than a voltage obtained by subtracting from said surface-firing voltage a wall voltage generated between said scanning electrode region and said common electrode region owing to the wall charge formed by sustaining discharge in said immediately preceding sub-field, and which is less than said surface-firing voltage to a second surface electrode which is said scanning electrode or said common electrode whichever is not said first surface electrode, to generate surface discharge only in the picture cell where sustaining discharge has occurred in said immediately preceding sub-field in order to form a negative wall charge in both said scanning electrode region and said common electrode region; and in said second sustaining erasing period, decreasing the potential of said first surface electrode to a third positive potential which is less than said first positive potential, whose potential difference from said first positive potential is not less than said opposed-firing voltage, and whose potential difference from the ground potential is less than said opposed-firing voltage and, at the same time, setting the potential of said second surface electrode to a fourth positive potential whose potential difference from the ground potential is less than said opposed-firing voltage to generate opposed discharge between said scanning electrode region or said common electrode region and said data electrode region to thereby adjust an amount of a wall charge in said scanning electrode region, said common electrode region, and said data electrode region in such a manner that both a magnitude of a wall voltage generated by said wall charge between said scanning electrode region and said data electrode region and a magnitude of a wall voltage generated between said common electrode region and said data electrode region may become less than said opposed-firing voltage.

16. The AC-type plasma display panel driving method according to claim 15, wherein said first surface electrode comprises said scanning electrode and said second surface electrode comprises said common electrode.

17. The AC-type plasma display panel driving method according to claim 15, wherein said first surface electrode comprises said common electrode and said second surface electrode comprises said scanning electrode.

18. The AC-type plasma display panel driving method according to claim 15, further comprising the steps of:

in said priming period, applying the ground potential to said data electrode and continuously increasing a potential applied to said scanning electrode from said fourth positive potential to a fifth positive potential which is higher than said fourth potential and whose potential difference from the ground potential is not less than said opposed-firing voltage and, at the same time, continuously changing a potential of said common electrode from said third positive potential to a sixth positive potential whose potential difference from said fifth positive potential is less than said opposed-firing voltage; and in said priming erasing period, while applying the ground potential to said data electrode, decreasing the potential of said scanning electrode from said fifth positive potential to a seventh positive potential which is less than said fifth positive potential and whose potential difference from said fifth positive potential is less than said opposed-firing voltage and then continuously decreasing from said seventh positive potential to the ground potential and, at the same time, applying said seventh positive potential to said common electrode.

19. The AC-type plasma display panel driving method according to claim 15, further comprising the steps of:

in said scanning period, applying an eighth positive potential whose potential difference from the ground potential is less than said opposed-firing voltage to said scanning electrode and sequentially applying to said scanning electrodes a negative scanning pulse decreasing in potential to the ground potential and, at the same time, applying a data pulse selectively to said data electrodes at the same timing as that of said scanning pulse based on said display data to thereby form a wall charge selectively in said picture cells; and in said sustaining period, applying a voltage to said scanning electrode and said common electrode alternately to generate sustaining discharge between said scanning electrode region and said common electrode region only in the picture cell where said wall charge has been formed so that said picture cell may emit light.

* * * * *

UNITED STATES PATENT AND TRADEMARK OFFICE

CERTIFICATE OF CORRECTION

PATENT NO. : 6,977,632 B2 
APPLICATION NO. : 10/300868
DATED : December 20, 2005
INVENTOR(S) : Eishi Mizobata It is certified that error appears in the above-identified patent and that said Letters Patent is hereby corrected as shown below:

Under Assignee:

Please delete: ~~NEC Plasma Display Corporation, Tokyo (JP)~~; and insert: Pioneer Corporation, Tokyo (JP)

Signed and Sealed this

Fourteenth Day of November, 2006

JON W. DUDAS
*Director of the United States Patent and Trademark Office*